US008491093B2

(12) United States Patent
Hagiwara et al.

(10) Patent No.: US 8,491,093 B2
(45) Date of Patent: Jul. 23, 2013

(54) LIQUID EJECTING HEAD UNIT, LIQUID EJECTING APPARATUS, AND METHOD OF PRODUCING LIQUID EJECTING APPARATUS

(75) Inventors: Hiroyuki Hagiwara, Matsumoto (JP); Masayuki Eguchi, Shiojiri (JP); Kimiyasu Otsuki, Azumino (JP); Masanori Mochizuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 76 days.

(21) Appl. No.: 13/315,261

(22) Filed: Dec. 8, 2011

(65) Prior Publication Data

US 2012/0147093 A1 Jun. 14, 2012

(30) Foreign Application Priority Data

Dec. 10, 2010 (JP) ..... 2010-275451

(51) Int. Cl.
*B41J 2/15* (2006.01)

(52) U.S. Cl.
USPC ..... 347/40; 347/37

(58) Field of Classification Search
USPC ..... 347/40, 43, 37
See application file for complete search history.

(56) References Cited

U.S. PATENT DOCUMENTS 6,652,062 B2 * 11/2003 Umeyama et al. ..... 347/20
7,322,394 B2 1/2008 Nakamura et al.
7,510,251 B2 * 3/2009 Wanibe et al. ..... 347/7

FOREIGN PATENT DOCUMENTS

JP 2007-090327 4/2007

* cited by examiner

*Primary Examiner* — Lamson Nguyen
(74) *Attorney, Agent, or Firm* — Workman Nydegger

(57) ABSTRACT

A liquid ejecting head unit includes a liquid ejecting head having a nozzle forming surface provided with nozzle rows consisting of several rows of nozzles for ejecting liquid; and a head fixing member to which the liquid ejecting head is fixed with an intermediate member therebetween. The liquid ejecting head has an intermediate-member fixing portion to which the intermediate member is fixed. The intermediate member has a head-fixing-member bonding surface to be securely bonded to an intermediate-member bonding surface of the head fixing member with adhesive. The head-fixing-member bonding surface has a chamfered portion along at least a portion of an outer edge thereof, the chamfered portion being provided such that the distance from the intermediate-member bonding surface gradually increases from the inner side toward the outer side of the head-fixing-member bonding surface.

9 Claims, 23 Drawing Sheets

LIQUID EJECTING HEAD UNIT, LIQUID EJECTING APPARATUS, AND METHOD OF PRODUCING LIQUID EJECTING APPARATUS

The entire disclosure of Japanese Patent Application No: 2010-275451, filed Dec. 10, 2010 is expressly incorporated by reference herein.

BACKGROUND

1. Technical Field

The present invention relates to a liquid ejecting head unit used in a liquid ejecting apparatus, such as an ink jet recording apparatus, and it also relates to a liquid ejecting apparatus and a method of producing the liquid ejecting apparatus. In particular, the invention relates to a liquid ejecting head unit, a liquid ejecting apparatus, and a method of producing the liquid ejecting apparatus in which a plurality of liquid ejecting heads are attached to a head fixing member in a removable manner.

2. Related Art

Liquid ejecting apparatuses include liquid ejecting heads that eject droplets of liquid. Various types of liquid can be ejected from the liquid ejecting heads. A typical example of the liquid ejecting apparatus is an image recording apparatus, such as an ink jet recording apparatus (printer) that has an ink jet recording head (a "recording head") and performs recording by ejecting droplets of liquid ink from nozzles in the recording head. In recent years, the application of the liquid ejecting apparatus is not limited to the image recording apparatus, but it can be applied to various types of manufacturing apparatuses, such as display manufacturing apparatuses. In image recording apparatuses, recording heads eject liquid ink, and in display manufacturing apparatuses, colorant ejecting heads eject red (R), green (G), and blue (B) colorant solutions. In addition, in electrode-producing apparatuses, electrode-material ejecting heads eject a liquid electrode material, and in chip manufacturing apparatuses, living-organic-material ejecting heads eject a living-organic-material solution.

In recent years, some printers employ a multi-head configuration, in which a single head unit includes a plurality of recording heads, each having nozzle rows consisting of several rows of nozzles, arranged side-by-side and fixed to a head fixing member, such as a sub-carriage. In a configuration in which the recording heads are positioned and screwed to the sub-carriage, the positioned recording heads are temporarily bonded to the sub-carriage with adhesive (for example, an instant adhesive) before screwed. This prevents the recording heads from being displaced by a rotational moment generated when they are securely screwed. If, as in this case, the recording heads are temporarily bonded to the sub-carriage with adhesive, it is difficult to remove the recording heads from the sub-carriage for repair or replacement. To overcome this problem, JP-A-2007-90327 proposes a configuration in which intermediate members called spacers are disposed between the sub-carriage and the recording heads. In that configuration, spacers are screwed to the recording heads in advance. The spacers are then temporarily bonded to the sub-carriage with adhesive and then securely screwed to the sub-carriage. By loosening the screws that fasten the spacers to the recording heads, the recording heads fixed to the sub-carriage can be removed from the spacers and the sub-carriage. Thus, the recording heads can be easily attached and removed for replacement or repair.

When the spacers are temporarily bonded to the sub-carriage with adhesive, the amount of injected adhesive may vary. In a head unit that is reduced in size by reducing the distance between adjacent liquid ejecting heads, an insufficient amount of adhesive may decrease the bonding strength between the sub-carriage and the spacers, deteriorating the positional accuracy of the liquid ejecting heads. In particular, if the positions of the nozzles in the head unit are shifted from each other, liquid ejected from the nozzles may miss the intended landing position on a recording medium. This may degrade the quality of an image recorded on the recording medium.

However, if the amount of adhesive is too large, the excess adhesive may flow out of a bonding surface (a mounting position) of the liquid ejecting head and cure at an unwanted position. For example, the adhesive may flow into the bonding surfaces of the adjacent liquid ejecting heads and cure before the liquid ejecting heads to be bonded to these bonding surfaces are bonded. Unevenness resulting from the adhesive deposited on the bonding surfaces of the adjacent liquid ejecting heads sometimes deteriorates the positional accuracy of the liquid ejecting heads bonded to these bonding surfaces.

This problem is not specific to the ink jet recording apparatus having recording heads for ejecting ink but is present in other liquid ejecting head units in which liquid ejecting heads are fixed to a head fixing member, such as the above-mentioned sub-carriage, with intermediate members, such as spacers, therebetween, and in liquid ejecting apparatuses having such liquid ejecting head units.

SUMMARY

An advantage of some aspects of the invention is that it provides a liquid ejecting head unit, a liquid ejecting apparatus, and a method of producing the liquid ejecting apparatus in which the liquid ejecting head is attached to a head fixing member with an intermediate member therebetween, with high positional accuracy.

A liquid ejecting head unit according to an aspect of the invention includes a liquid ejecting head having a nozzle forming surface provided with nozzle rows consisting of several rows of nozzles for ejecting liquid, and a head fixing member to which the liquid ejecting head is fixed with an intermediate member therebetween. The liquid ejecting head has an intermediate-member fixing portion to which the intermediate member is fixed. The intermediate member has a head-fixing-member bonding surface to be securely bonded to an intermediate-member bonding surface of the head fixing member with adhesive. The head-fixing-member bonding surface has a chamfered portion along at least a portion of an outer edge thereof, the chamfered portion being provided such that the distance from the intermediate-member bonding surface gradually increases from the inner side toward the outer side of the head-fixing-member bonding surface. Herein, the term "chamfered" means that an edge where two surfaces meet is beveled or rounded.

In the above-described configuration, the liquid ejecting head has an intermediate-member fixing portion to which the intermediate member is fixed, the intermediate member has a head-fixing-member bonding surface to be securely bonded to an intermediate-member bonding surface of the head fixing member with adhesive, and the head-fixing-member bonding surface has a chamfered portion along at least a portion of an outer edge thereof, the chamfered portion being provided such that the distance from the intermediate-member bonding surface gradually increases from the inner side toward the outer side of the head-fixing-member bonding surface.

Accordingly, it is possible to guide the adhesive injected from the chamfered portion to a gap between the head-fixing-member bonding surface of the intermediate member and the intermediate-member bonding surface by capillary force and distribute the adhesive over the gap, and it is possible to utilize the chamfered portion as a buffer in which the adhesive is stored. Thus, it is possible to prevent the adhesive from flowing out of the outer edge of the intermediate member, making the adhesive easily flow along the outer edge of the intermediate member. This improves the bonding between the head fixing member and the intermediate member, increasing the accuracy of mounting position of the liquid ejecting head.

In the above-described configuration, a step portion that is recessed toward a side opposite to the head-fixing-member bonding surface may be provided along a boundary of the head-fixing-member bonding surface and the chamfered portion.

In the above-described configuration, a step portion that is recessed toward a side opposite to the head-fixing-member bonding surface is provided along a boundary of the head-fixing-member bonding surface and the chamfered portion. Thus, the adhesive is guided to the step portion by capillary force, making the adhesive flow more easily along the boundary of the head-fixing-member bonding surface and the chamfered portion, i.e., along the outer edge of the head-fixing-member bonding surface. Furthermore, the step portion may be utilized as a buffer in which the adhesive is stored.

In the above configuration, the head fixing member may have a head attaching portion provided with the intermediate-member bonding surface and have an adhesive receiving portion that is provided on the outer side of the head attaching portion and recessed toward a side opposite to the intermediate-member bonding surface. The head attaching portion may have the shape of an island protruding toward the head-fixing-member bonding surface.

In the above-described configuration, the head fixing member has a head attaching portion provided with the intermediate-member bonding surface and has an adhesive receiving portion that is provided on the outer side of the head attaching portion and recessed toward a side opposite to the intermediate-member bonding surface. The head attaching portion has the shape of an island protruding toward the head-fixing-member bonding surface. This increases the shape and dimensional accuracy of the intermediate-member bonding surface, improving the positional accuracy of the intermediate member to be securely bonded to the intermediate-member bonding surface. Furthermore, the adhesive flowing out of the intermediate-member bonding surface of the head attaching portion can be collected in the adhesive receiving portion. Thus, the adhesive flowing out of the intermediate-member bonding surface can be prevented from flowing in the intermediate-member bonding surface of the adjacent liquid ejecting head when more than one liquid ejecting heads are arranged side-by-side on the head fixing member.

In the above configuration, the intermediate member may have an insertion hole through which a fastening member for fastening the intermediate member to the head fixing member is inserted, the insertion hole being provided with a spot facing portion around its opening in the bonding surface of the head-fixing member.

In the above-described configuration, the intermediate member has an insertion hole through which a fastening member for fastening the intermediate member to the head fixing member is inserted, the insertion hole being provided with a spot facing portion around its opening in the bonding surface of the head-fixing member. Thus, the adhesive flowing in the insertion hole from the bonding surface can be stored in the spot facing portion. Accordingly, the adhesive can be prevented from flowing upward in the insertion hole from the head-fixing-member bonding surface side toward the liquid ejecting head side on the opposite side. As a result, the overflowed adhesive can be prevented from being deposited on the liquid ejecting head.

Furthermore, a liquid ejecting apparatus according to an aspect of the invention includes the liquid ejecting head unit according to any one of the above-described configurations. This configuration improves the positional accuracy of the nozzles in the liquid ejecting head, increasing the landing position accuracy of liquid on the landing target.

Furthermore, a method of producing a liquid ejecting apparatus that includes a liquid ejecting head having a nozzle forming surface provided with nozzle rows consisting of several rows of nozzles for ejecting liquid, and a head fixing member to which the liquid ejecting head is fixed with an intermediate member therebetween according to an aspect of the invention includes an intermediate-member fixing step in which the intermediate member is fixed to an intermediate-member fixing portion of the liquid ejecting head, and a bonding step in which a head-fixing-member bonding surface of the intermediate member is securely bonded to the intermediate-member bonding surface of the head fixing member with adhesive. The head-fixing-member bonding surface has a chamfered portion along at least a portion of an outer edge thereof, the chamfered portion being provided such that the distance from the intermediate-member bonding surface gradually increases from the inner side toward the outer side of the head-fixing-member bonding surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the attached drawings. Although the embodiments of the invention described below include various limitations as preferred examples, the scope of the invention is not limited to these examples unless otherwise specifically stated herein. Furthermore, in the following description, an ink jet recording apparatus (a "printer") will be described as an exemplary liquid ejecting apparatus according to an aspect of the invention.

Figure 1:
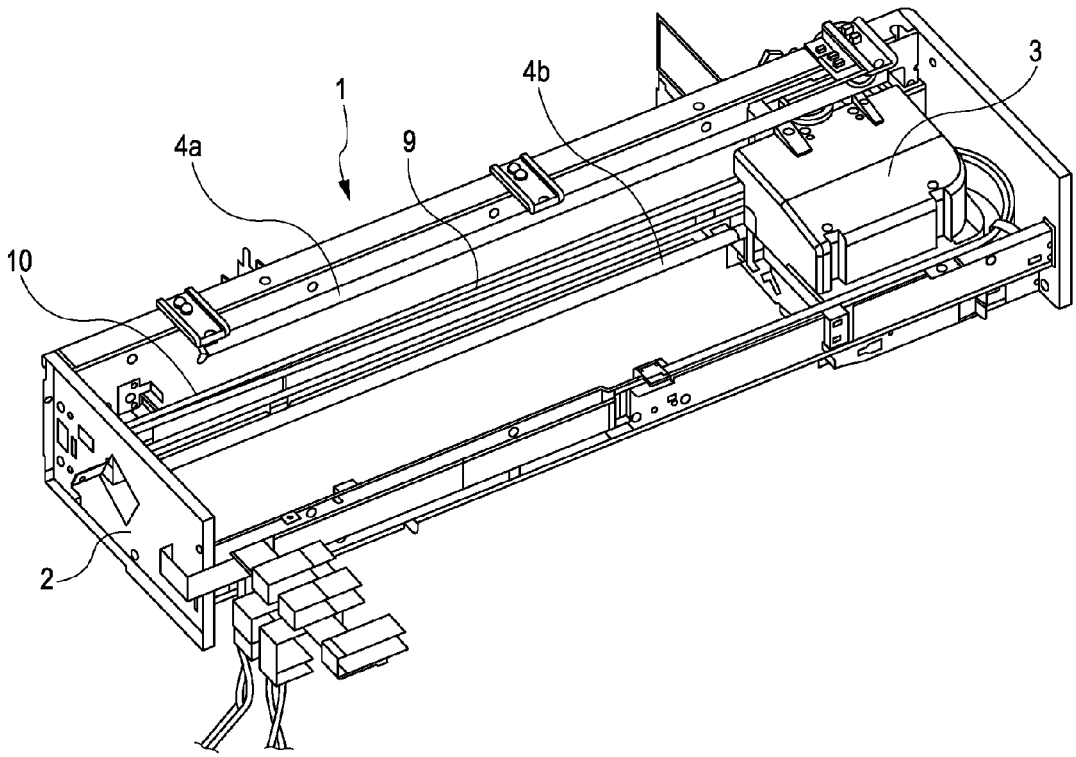
FIG. 1 is a perspective view showing a part of the internal structure of a printer.
Figure 2:
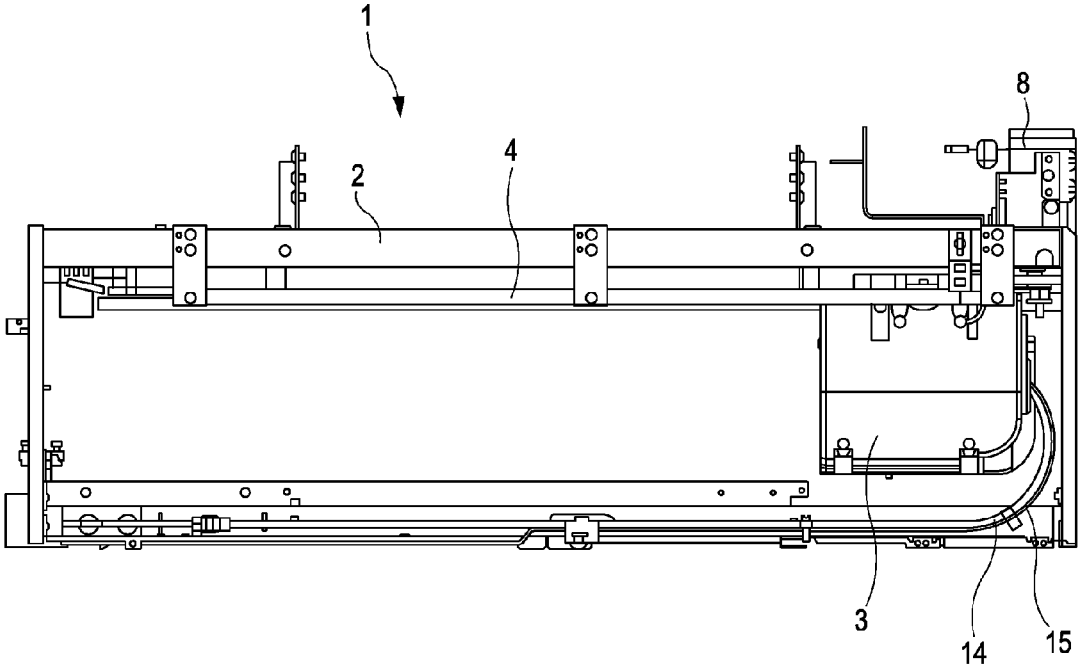
FIG. 2 is a plan view of a part of the internal structure of the printer.

FIG. 1 is a perspective view showing a part of the internal structure of a printer 1, and FIG. 2 is a plan view of the printer 1. The printer 1 ejects ink, which is a type of liquid, onto a recording medium (a landing target), such as a recording sheet, cloth, or a film. In the printer 1, a carriage 3 (a type of head unit holding member) is installed in a frame 2 so as to be movable back and forth in a main scanning direction, i.e., a direction intersecting a recording-medium feeding direction. A pair of upper and lower guide rods 4*a* and 4*b* that are elongated in the longitudinal direction of the frame 2 and parallel to each other with a certain distance therebetween are attached to the inner wall of the frame 2 on the back surface of the printer 1. The guide rods 4*a* and 4*b* are fitted to a rod-receiving portion 7 (see FIG. 4) or the like provided on the back surface of the carriage 3, thereby supporting the carriage 3 so as to be slidable.

A carriage motor 8, serving as a driving source for moving the carriage 3, is provided at one end of the back surface of the frame 2 in the main scanning direction (the right end in FIG. 2). The driving shaft of the carriage motor 8 protrudes from the back surface of the frame 2 toward the inner surface side, and a driving pulley (not shown) is connected to the tip thereof. By driving the carriage motor 8, the driving pulley is rotated. Furthermore, an idler pulley (not shown) is provided at a position opposite to the driving pulley in the main scanning direction (the left end in FIG. 2). A timing belt 9 is wound around these pulleys. The carriage 3 is connected to the timing belt 9. When the carriage motor 8 is driven, the driving pulley are rotated, causing the timing belt 9 to run and moving the carriage 3 in the main scanning direction along the guide rods 4*a* and 4*b*.

On the inner wall of the back surface of the frame 2, a linear scale 10 (an encoder film) parallel to the guide rods 4*a* and 4*b* is provided in the main scanning direction. The linear scale 10 is a belt-like (band-like) member made of a transparent resin film, and it is, for example, a transparent base film on which a plurality of non-transparent stripes are printed so as to cross the width direction of the belt. The stripes have the same width and are formed at a predetermined pitch in the longitudinal direction of the band. Furthermore, a linear encoder (not shown) that optically reads the stripes of the linear scale 10 is provided on the back surface of the carriage 3. The linear encoder is a type of position-information output unit, and it outputs encoder pulses according to the scanning position of the carriage 3 as the position information in the main scanning direction. Thus, a control unit (not shown) of the printer 1 can control a recording operation of a head unit 17 with respect to a recording medium, while recognizing the scanning position of the carriage 3 according to the encoder pulses. The printer 1 is configured to be able to perform bi-directional recording processing, in which characters and images are recorded on a recording sheet bi-directionally, i.e., when the carriage 3 moves forth from a home position at one end toward a full position at the other end and when the carriage 3 moves back from the full position toward the home position in the main scanning direction.

As shown in FIG. 2, an ink supply tube 14 for supplying color inks to recording heads 18 of the head unit 17, and a signal cable 15 for supplying signals, such as driving signals, are connected to the carriage 3. In addition, the printer 1 includes a cartridge fitting portion to which ink cartridges (liquid supply sources) containing ink are attached in a removable manner, a conveying unit that conveys recording sheets, a capping unit that covers nozzle forming surfaces 53 (see FIG. 13) of the recording heads 18 in a stand-by state, etc, which are not shown in the figures.

Figure 3:
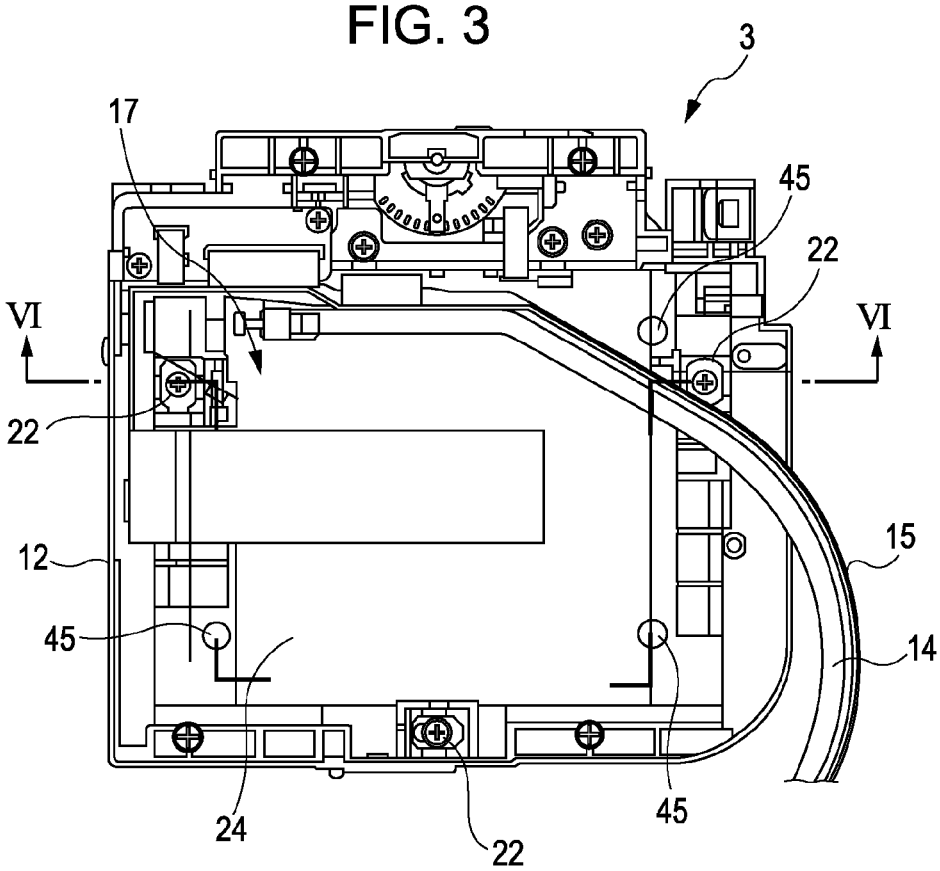
FIG. 3 is a top view of a carriage.
Figure 4:
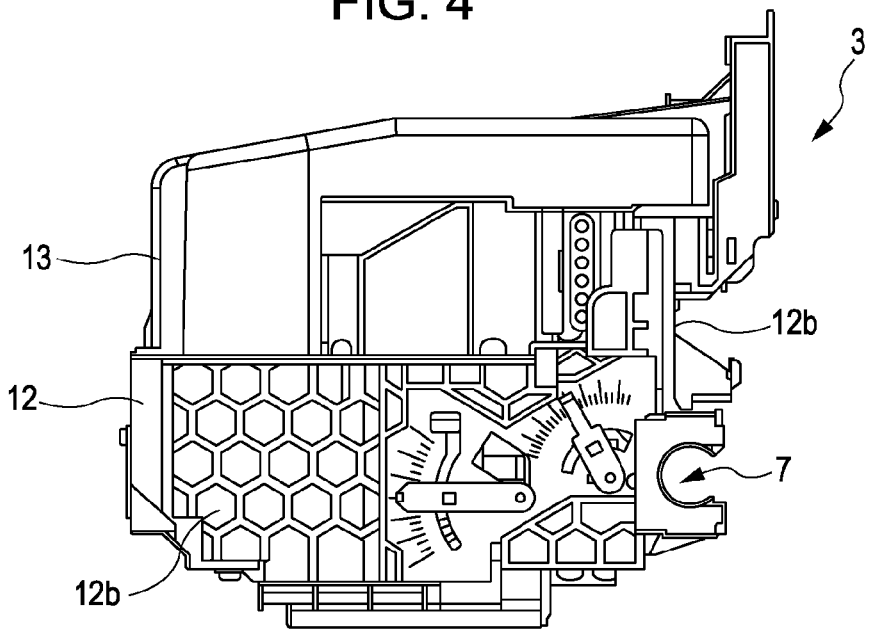
FIG. 4 shows the carriage viewed from the right side.
Figure 5:
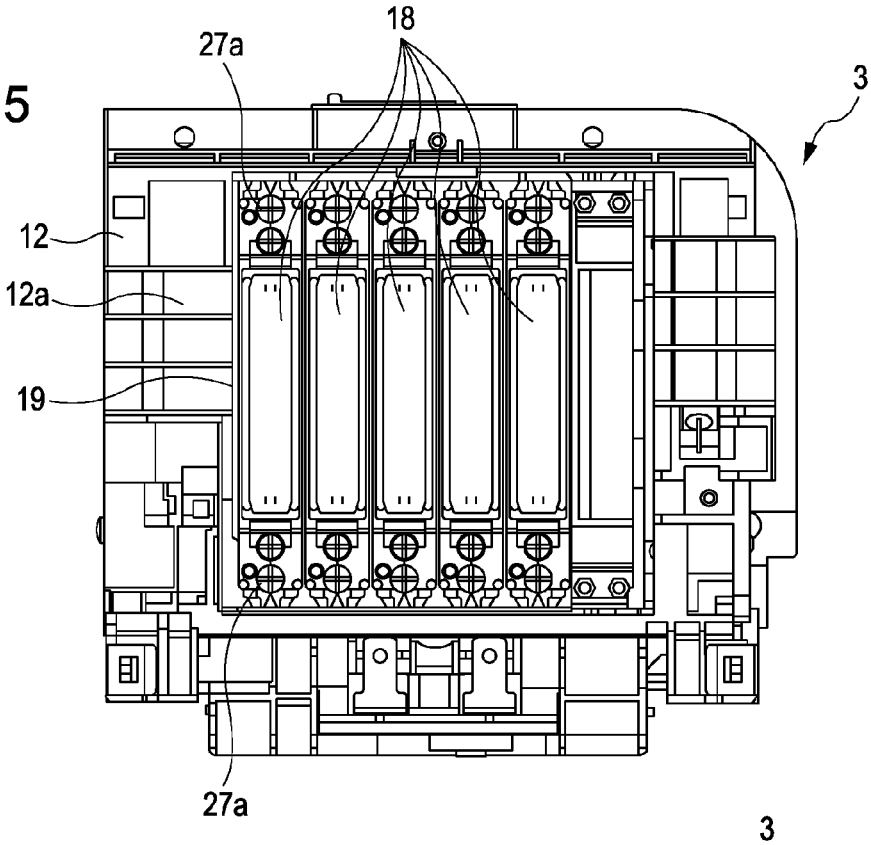
FIG. 5 is a bottom view of the carriage.
Figure 6:
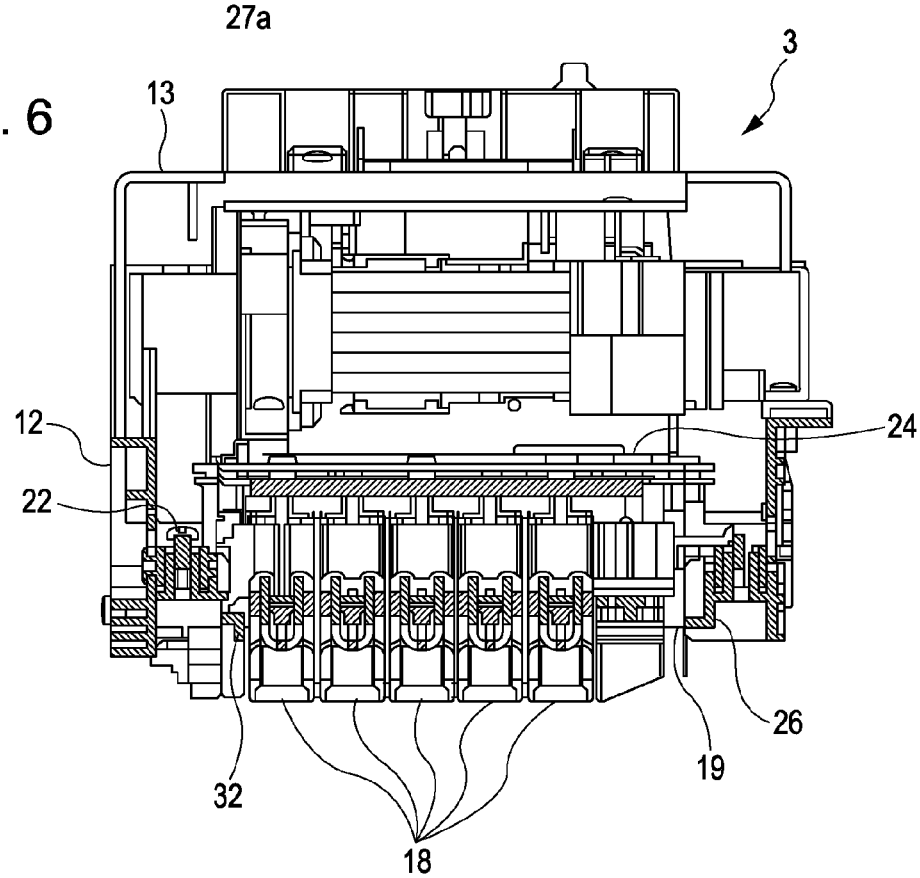
FIG. 6 is a cross-sectional view taken along line VI-VI in FIG. 3.

FIG. 3 is a plan view (top view) of the carriage 3, FIG. 4 shows the carriage 3 viewed from the right side, and FIG. 5 is a bottom view of the carriage 3. Furthermore, FIG. 6 is a cross-sectional view taken along line VI-VI in FIG. 3. FIG. 3 shows the carriage 3 without a carriage cover 13. The carriage 3 is a hollow box-like member that can be divided into an upper part and a lower part and includes a carriage body 12 that accommodates a head unit 17 (a type of liquid ejecting head unit of the invention, which will be described below), and a carriage cover 13 that covers the top opening of the carriage body 12. The carriage body 12 includes a substantially rectangular bottom plate 12*a* (see FIG. 5) and side walls 12*b* (see FIG. 4) standing upright from four sides of the bottom plate 12*a*, and accommodates the head unit 17 in the space surrounded by the bottom plate 12*a* and the side walls 12*b*. The bottom plate 12*a* has a bottom opening 19 through which the nozzle forming surfaces 53 of the recording heads 18 of the head unit 17 accommodated in the carriage body 12 are exposed. When the head unit 17 is accommodated in the carriage body 12, the nozzle forming surfaces 53 of the recording heads 18 protrude downward with respect to the bottom of the carriage body 12 (toward the recording medium in a recording operation) from the bottom opening 19 in the bottom plate 12*a*.

Figure 7A:
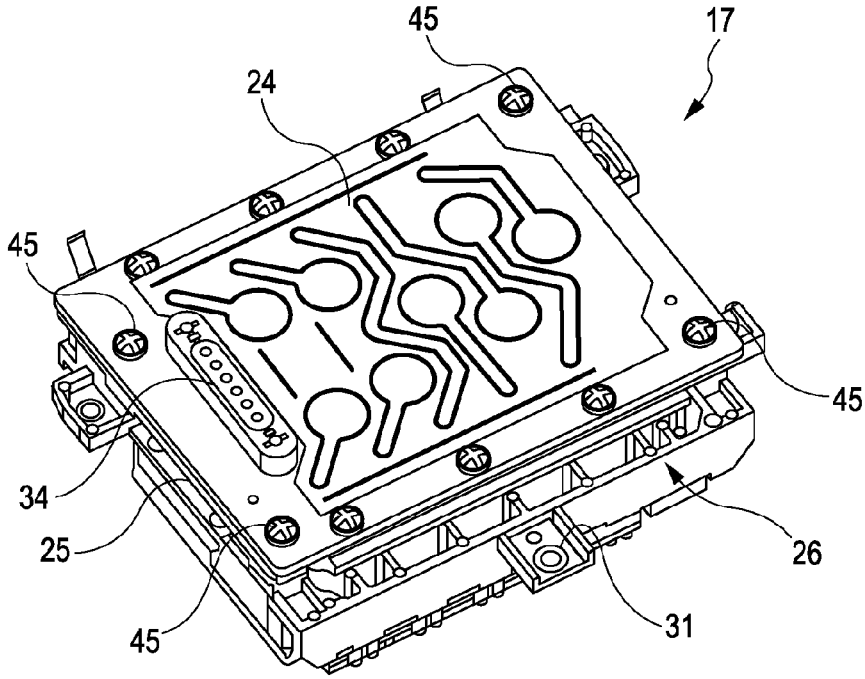
FIGS. 7A and 7B are perspective views of a head unit.
Figure 7B:
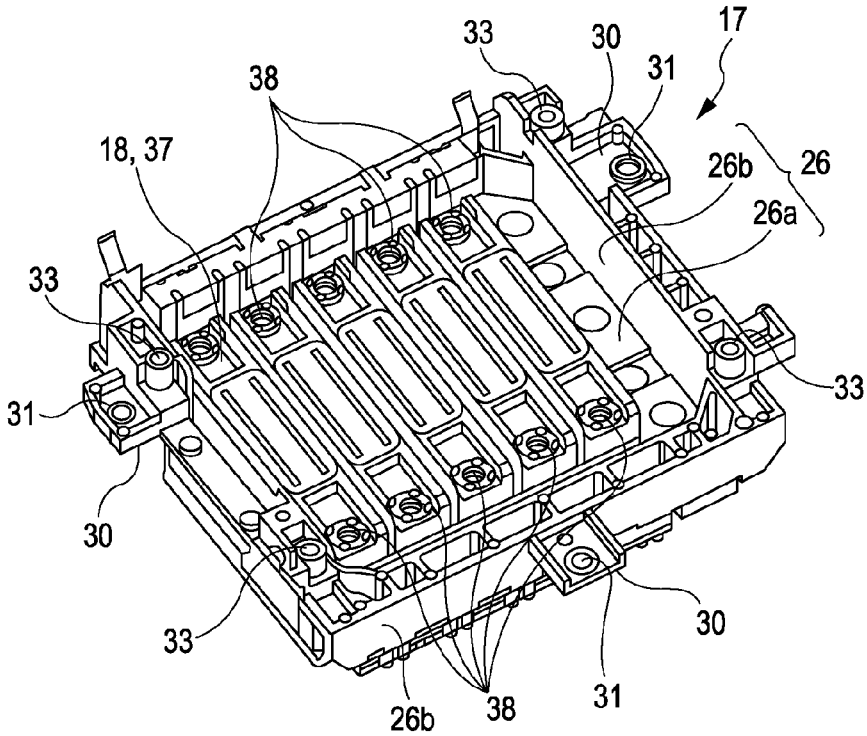
Figure 8:
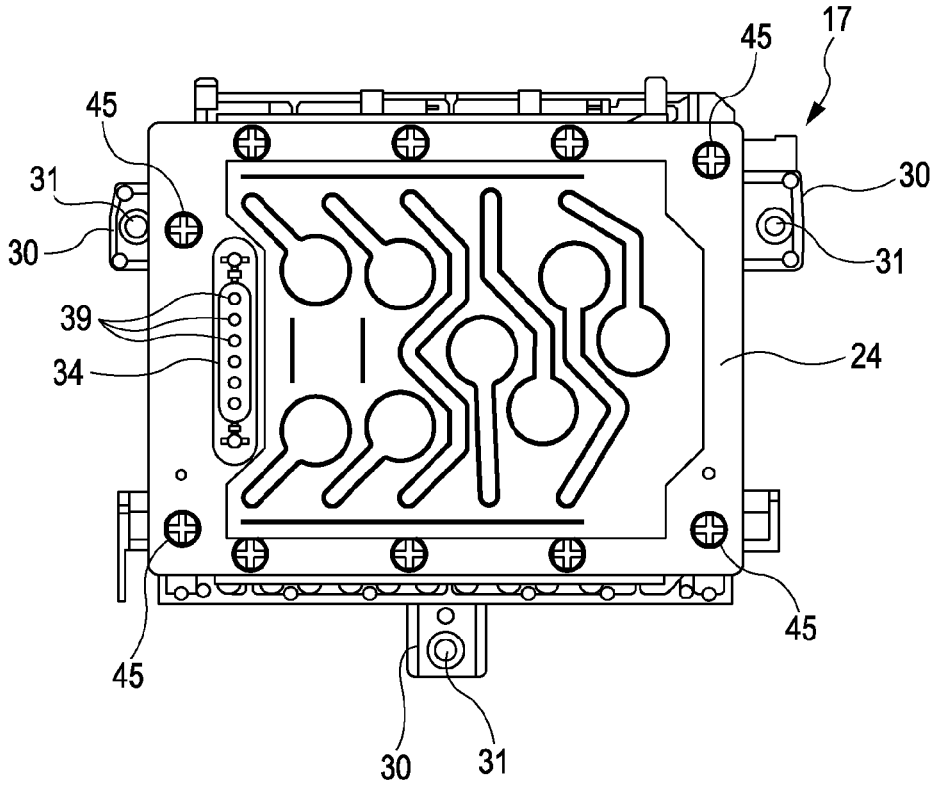
FIG. 8 is a top view of the head unit.
Figure 9:
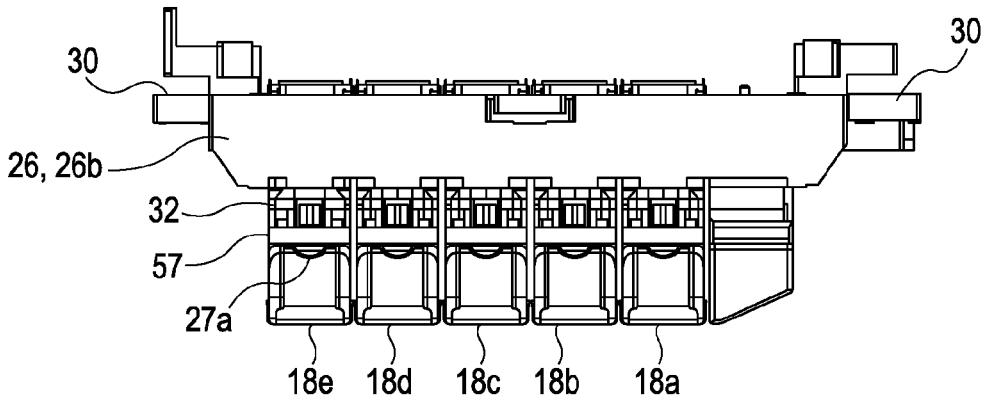
FIG. 9 is a front view of the head unit.
Figure 10:
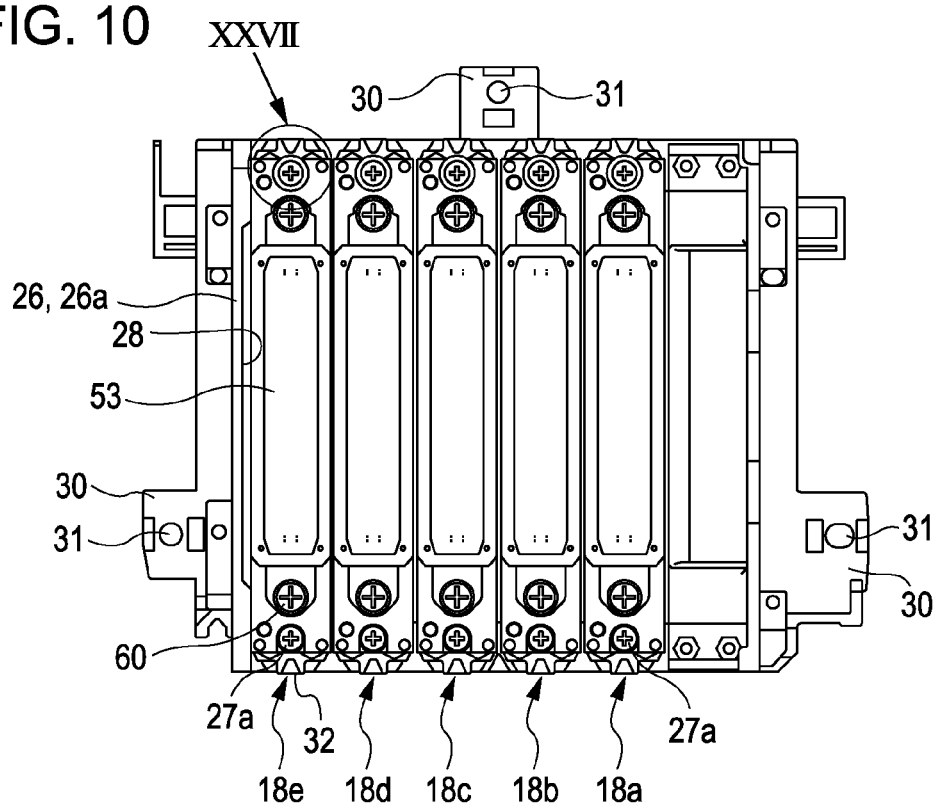
FIG. 10 is a bottom view of the head unit.
Figure 11:
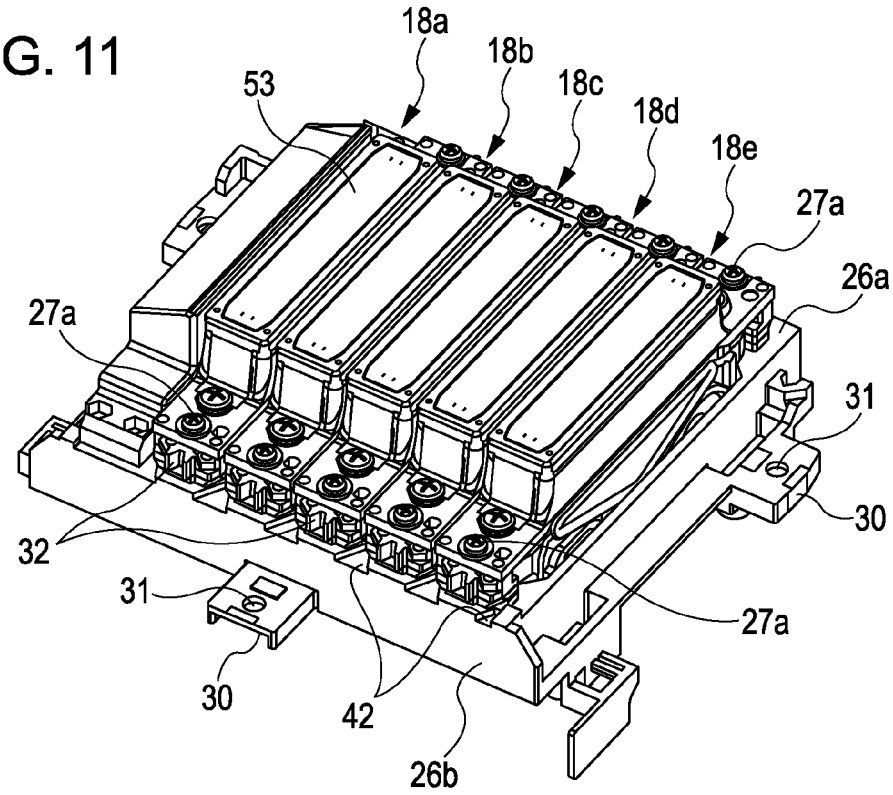
FIG. 11 is a perspective view of the head unit as viewed from the bottom surface.
Figure 12:
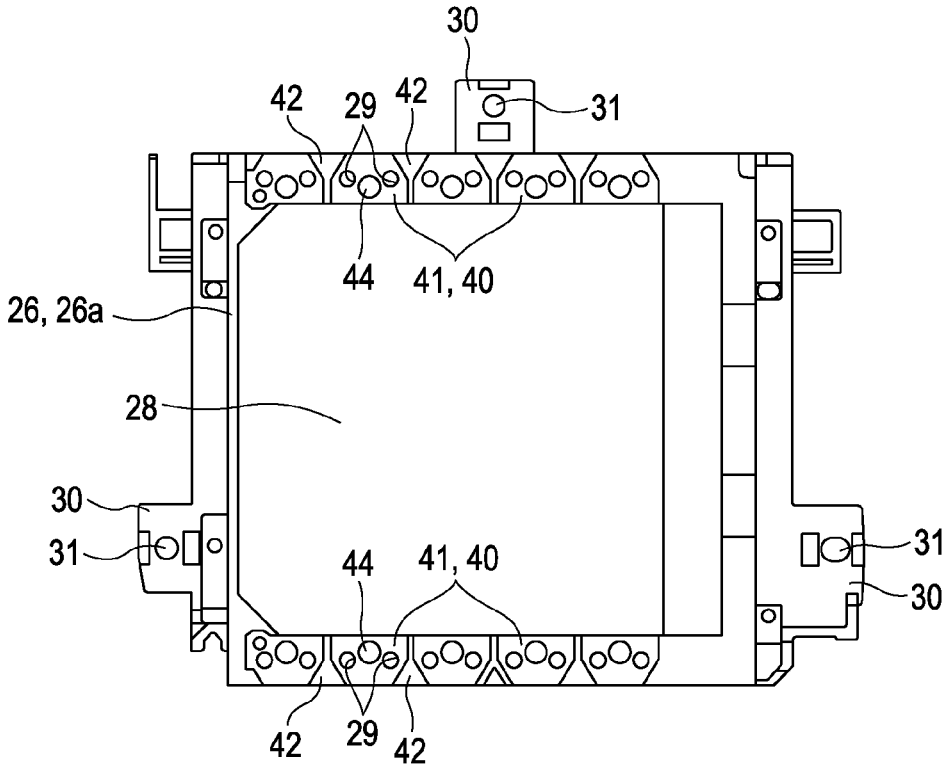
FIG. 12 is a bottom view showing the configuration of a sub-carriage.

FIGS. 7A and 7B are perspective views of the head unit 17 with and without a flow path member 24, respectively. Furthermore, FIG. 8 is a top view of the head unit 17, FIG. 9 is a front view of the head unit 17 (without the flow path member 24), FIG. 10 is a bottom view of the head unit 17, FIG. 11 is a perspective view of the head unit 17 as viewed from the bottom surface, and FIG. 12 is a bottom view of a sub-carriage 26 to which the recording heads 18 are attached.

The head unit 17 including a plurality of recording heads 18 has a flow path member 24 and the sub-carriage 26 (a type of head fixing member of the invention) to which the recording heads 18 are attached. The sub-carriage 26 is an open-topped hollow box composed of a plate-like base portion 26*a*, to which the recording heads 18 are fixed, and upright walls 26*b* standing upright from four sides of the base portion 26*a*. A space surrounded by the base portion 26*a* and the four upright walls 26*b* serves as an accommodating portion that accommodates at least a portion of the recording heads 18 (mainly, sub-tanks 37). The sub-carriage 26 according to this embodiment is made of metal (e.g., aluminum) and is more rigid than the carriage body 12 and the carriage cover 13. The sub-carriage 26 does not necessarily have to be made of metal, but it may be made of synthetic resin.

The base portion 26*a* of the sub-carriage 26 has a head insertion opening 28, into which the plurality of recording heads 18 can be inserted, substantially at the central portion thereof (that is, the insertion opening 28 is common to the recording heads 18). Thus, the base portion 26*a* has the shape of a frame composed of four sides. A plurality of head attaching portions 40 are provided side-by-side on the lower surface of the base portion 26*a* (the surface facing a recording medium during recording) at positions where the recording heads 18 are to be mounted (see FIG. 12). In this embodiment, two head attaching portions 40 corresponding to spacers 32 (described below) are provided for each recording head 18. The head attaching portions 40 are provided on both sides of the head insertion opening 28 in the direction along the nozzle rows (a direction perpendicular to the direction along the head rows).

In plan view, the head attaching portions 40 have the shape of a home plate conforming to a portion of the outer shape of the spacers 32 (see FIG. 23 etc.), and the lower surfaces thereof (the surfaces facing a recording medium during recording) serve as spacer bonding surfaces 41 (a type of intermediate-member bonding surface of the invention) to be securely bonded to base surfaces 65 of the spacers 32 with adhesive in a temporary fixing step. Accordingly, the shape and dimensional accuracy of the spacer bonding surfaces 41 of the head attaching portions 40 has to be high. In particular, it is preferable that these spacer bonding surfaces 41 be flat and free from unevenness, except for necessary screw holes (fastening holes 29, bolt accommodating portions 44, etc.). Furthermore, adhesive receiving portions 42 that are recessed toward a side opposite to the spacer bonding surfaces 41 (toward the depth side with respect to the plane of the sheet of FIG. 12) are provided on the outer side of the head attaching portions 40 on the lower surface of the base portion 26*a* of the sub-carriage 26. That is, the head attaching portions 40 have the shape of an isolated island because of the adhesive receiving portions 42 formed on both sides thereof and protrude downward (toward a recording medium during a recording operation, i.e., toward the base surfaces 65 of the spacers 32 that are securely bonded to the spacer bonding surfaces 41) from the base portion 26*a*. Because the head attaching portions 40 have the shape of an island protruding toward the base surfaces 65 of the spacers 32, by strictly controlling the shape and dimension of the head attaching portions 40 (the spacer bonding surfaces 41) during fabrication of the sub-carriage 26, the positional accuracy of the recording heads 18 attached to the head attaching portions 40 is improved. Furthermore, the adhesive receiving portions 42 capture the adhesive flowing out of the spacer bonding surfaces 41 of the head attaching portions 40.

Figure 28:
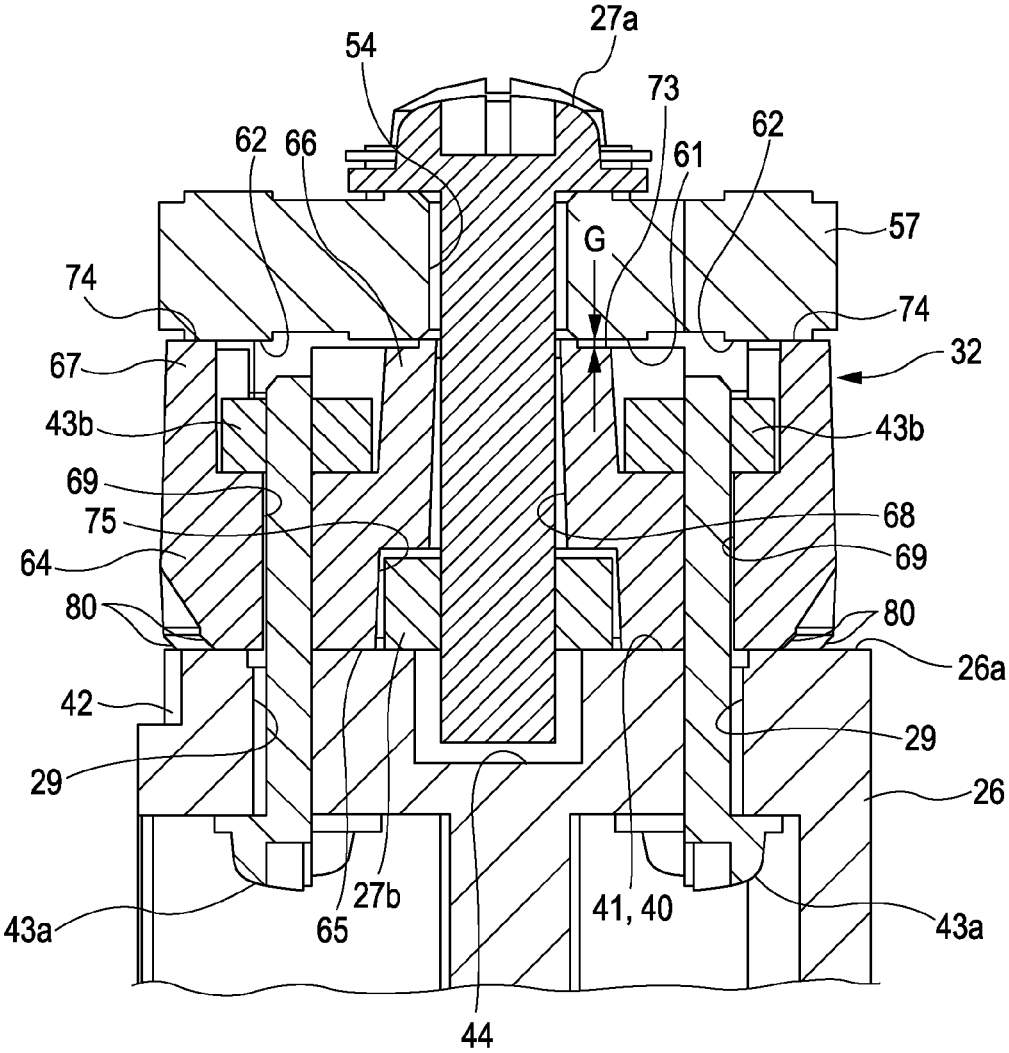
FIG. 28 is a cross-sectional view taken along line XXVIII-XXVIII in FIG. 27.

These head attaching portions 40 each have the fastening holes 29 (see FIGS. 12 and 28). In this embodiment, two fastening holes 29 are arranged side-by-side in a direction perpendicular to the direction along the nozzle rows in the head attaching portions 40 (the direction in which the heads are arranged) so as to correspond to sub-carriage insertion holes 69 in the spacer 32. Furthermore, each head attaching portion 40 has a bolt accommodating portion 44 between the fastening holes 29, at a position close to the head insertion opening 28, that corresponds to a spacer attaching hole 54 in a flange portion 47 of the recording head 18 (described below) and a head insertion hole 68 in the spacer 32. The bolt accommodating portion 44 is recessed from the spacer bonding surface 41 to a certain point of the head attaching portion 40 in the thickness direction, and it accommodates the tip of the shaft of a spacer-fixing bolt 27*a* inserted from the spacer attaching hole 54 and penetrating through the spacer attaching hole 54 and the head insertion hole 68.

In this embodiment, as shown in FIG. 10, five recording heads 18, namely, a first recording head 18*a*, a second recording head 18*b*, a third recording head 18*c*, a fourth recording head 18*d*, and a fifth recording head 18*e*, are accommodated in the accommodating portion such that the sub-tanks 37 (described below) penetrate downward through the head insertion opening 28. The recording heads 18 are arranged side-by-side in a direction perpendicular to the nozzle rows and fixed to the base portion 26*a* with the spacers 32 therebetween.

As shown in FIGS. 7 and 8, three of the four upright walls 26*b* of the sub-carriage 26 have a flange portion 30 projecting to the side. The flange portions 30 each have an insertion hole 31 corresponding to three attaching screw holes (not shown) provided in the bottom plate 12*a* of the carriage body 12, at a mounting position of the head unit 17. By aligning the insertion holes 31 with the attaching screw holes in the bottom plate 12*a* of the carriage body 12 and by fastening head-unit fixing screws 22 to the attaching screw holes through the insertion holes 31, the head unit 17 is accommodated in and fixed to the carriage body 12. A total of four fixing screw holes 33, to which the flow path member 24 is fixed, are provided in the upper end surfaces of the four upright walls 26*b* of the sub-carriage 26.

The flow path member 24 made of, for example, synthetic resin has the shape of a box having a small thickness in the top-bottom direction. Ink distributing flow paths (not shown) for the respective color inks, which correspond to flow-path connecting portions 38 of the sub-tanks 37 (described below) of the recording heads 18, are defined in the flow path member 24. A tube connecting portion 34 is provided on the top surface (the surface opposite to the surface fixed to the sub-carriage 26) of the flow path member 24. As shown in FIG. 8, a plurality of introduction ports 39 corresponding to the respective color inks are provided in the tube connecting portion 34. The introduction ports 39 communicate with the corresponding ink distributing flow paths. When the ink supply tube 14 is connected to the tube connecting portion 34, the ink supply paths for the respective colors in the ink supply tube 14 are brought into communication with the corresponding introduction ports 39 in a liquid-tight manner. Thus, the color inks flowing from the ink cartridges through the ink supply tube 14 are introduced into the ink distributing flow paths in the flow path member 24 through the introduction ports 39. Furthermore, connecting flow paths (not shown) are provided on the lower surface of the flow path member 24, at positions corresponding to the flow-path connecting portions 38 of the sub-tanks 37 of the recording heads 18. The connecting flow paths are inserted into and connected to the flow-path connecting portions 38 of the sub-tanks 37 of the recording heads 18 in a liquid-tight manner. In addition, the flow path member 24 has flow-path insertion holes (not shown) penetrating in the thickness direction at the four corners thereof so as to correspond to the fixing screw holes 33 in the sub-carriage 26. When the flow path member 24 is fixed to the sub-carriage 26, flow-path fastening screws 45 penetrating through the flow-path insertion holes are fastened to (meshed with) the fixing screw holes 33. The ink flowing through the ink distributing flow paths in the flow path member 24 is supplied to the sub-tanks 37 of the recording heads 18 through the connecting flow paths and the flow-path connecting portions 38.

Figure 13:
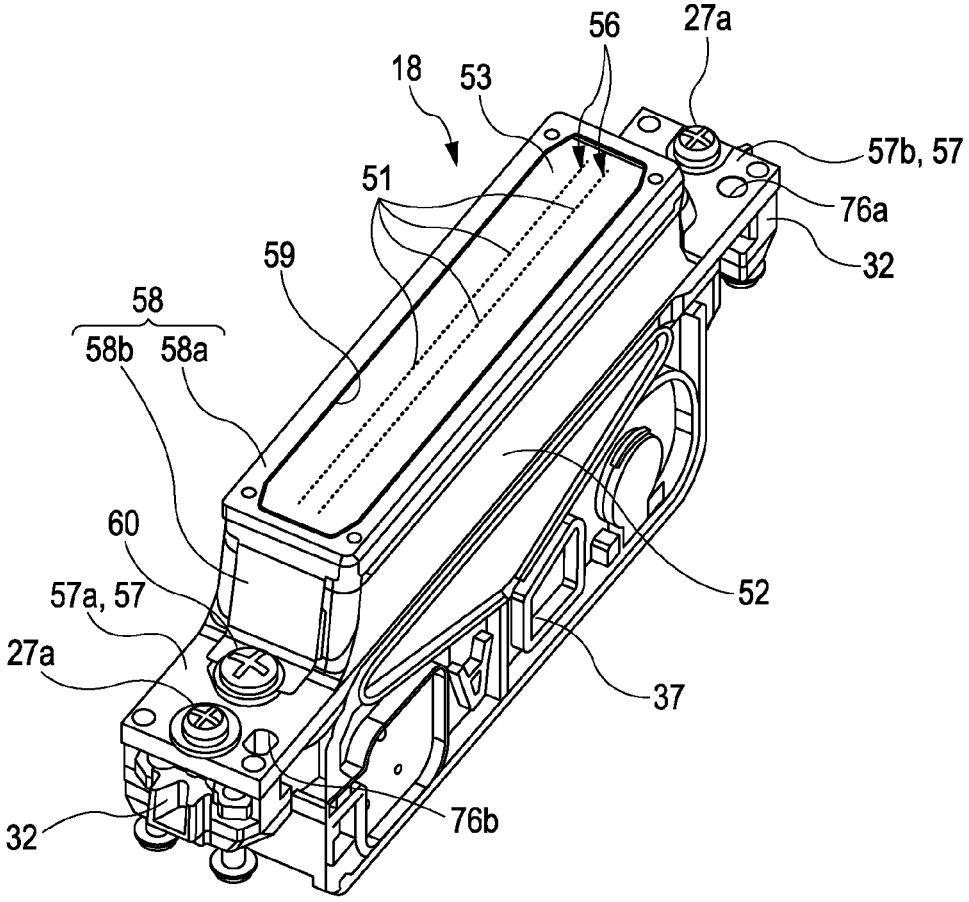
FIG. 13 is a perspective view showing the configuration of a recording head.
Figure 14A:
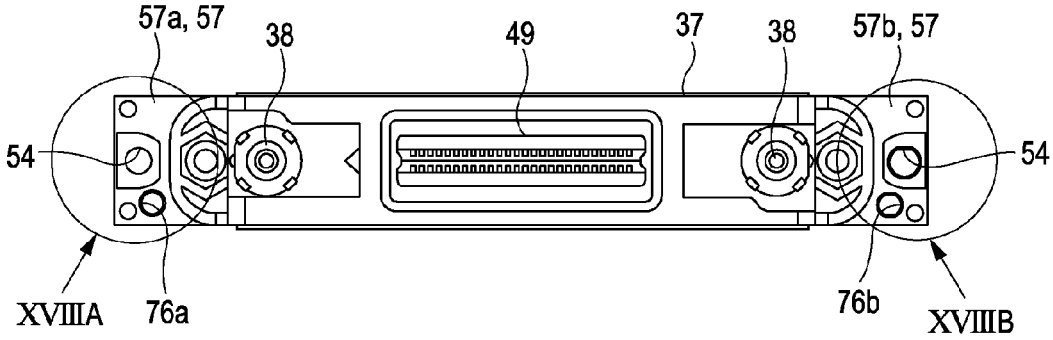
FIGS. 14A and 14B are top views showing the configuration of the recording head.
Figure 14B:
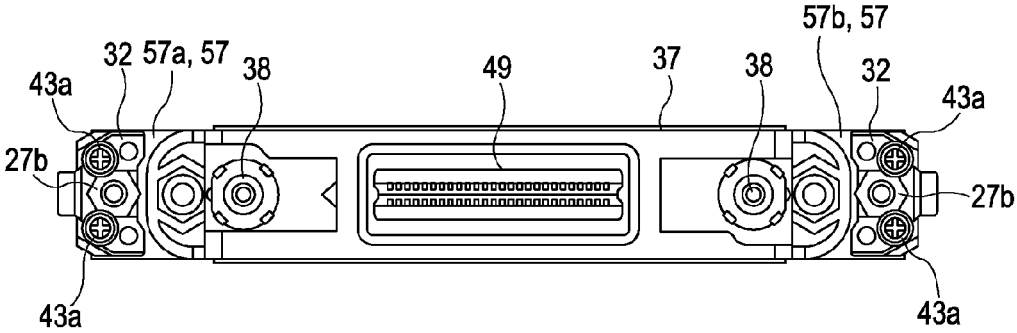
Figure 15A:
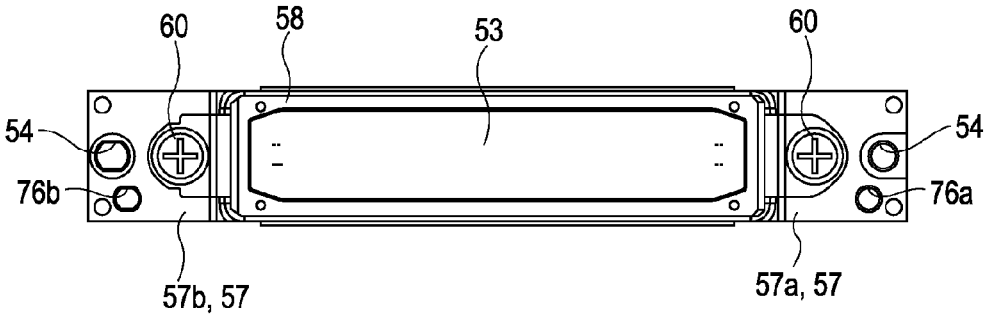
FIGS. 15A and 15B are bottom views showing the configuration of the recording head.
Figure 15B:
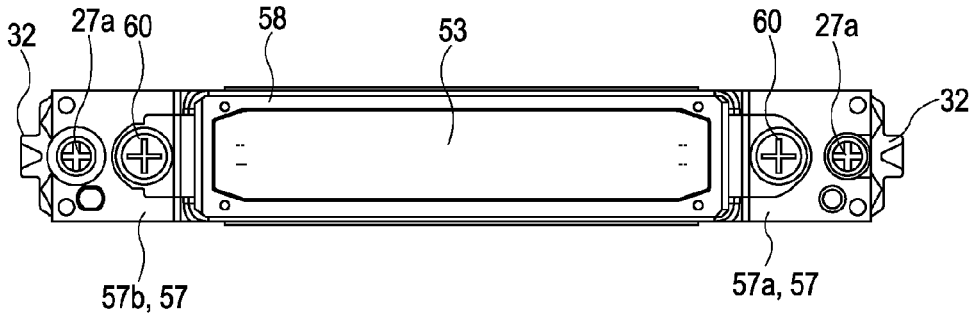
Figure 16A:
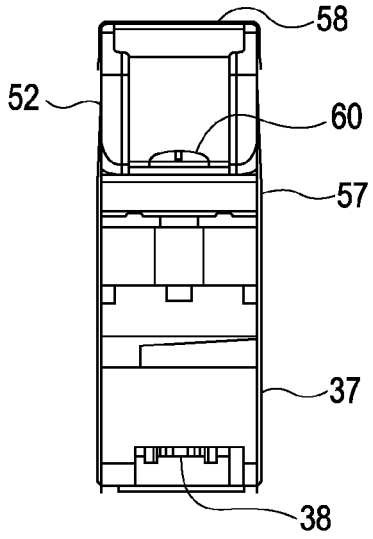
FIGS. 16A and 16B are front views showing the configuration of the recording head.
Figure 16B:
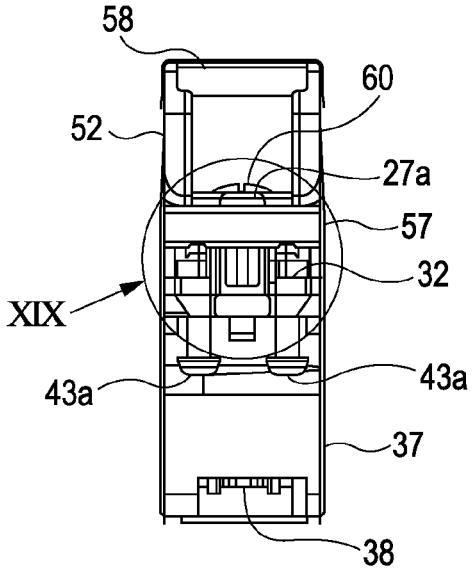
Figure 17A:
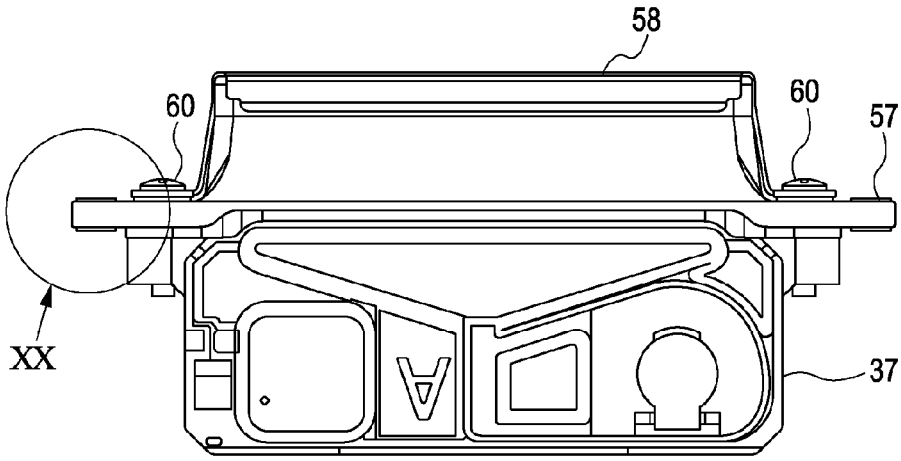
FIGS. 17A and 17B are right side views showing the configuration of the recording head.
Figure 17B:
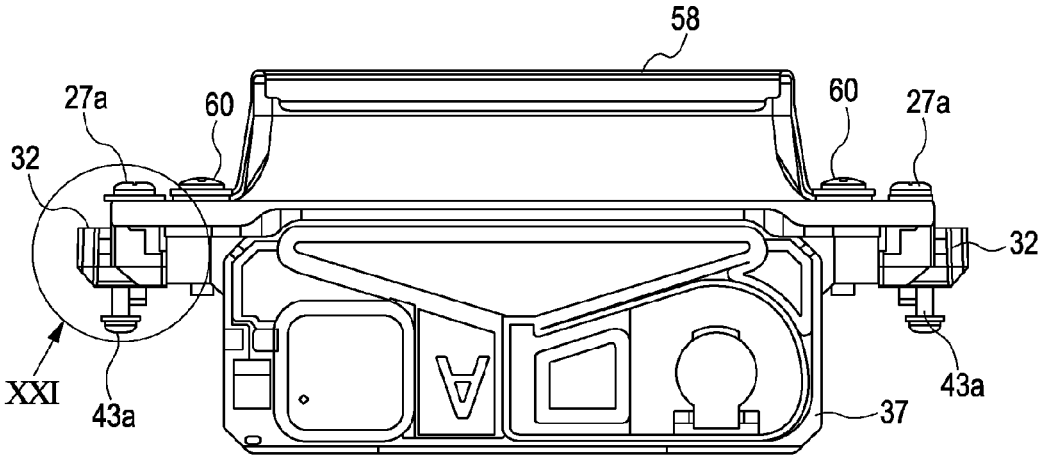
Figure 18A:
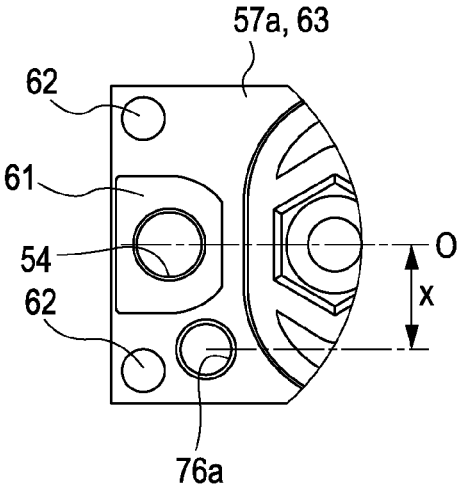
FIGS. 18A and 18B are enlarged views of region XVIIIA and region XVIIIB in FIG. 14, respectively.
Figure 18B:
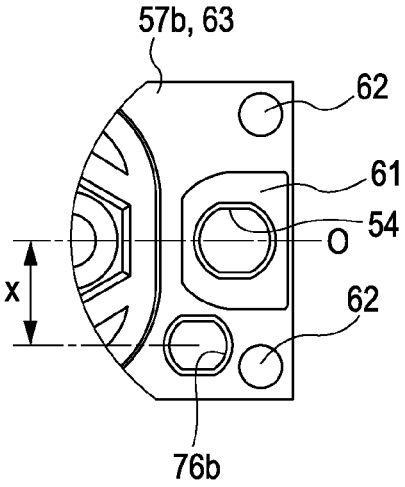
Figure 19:
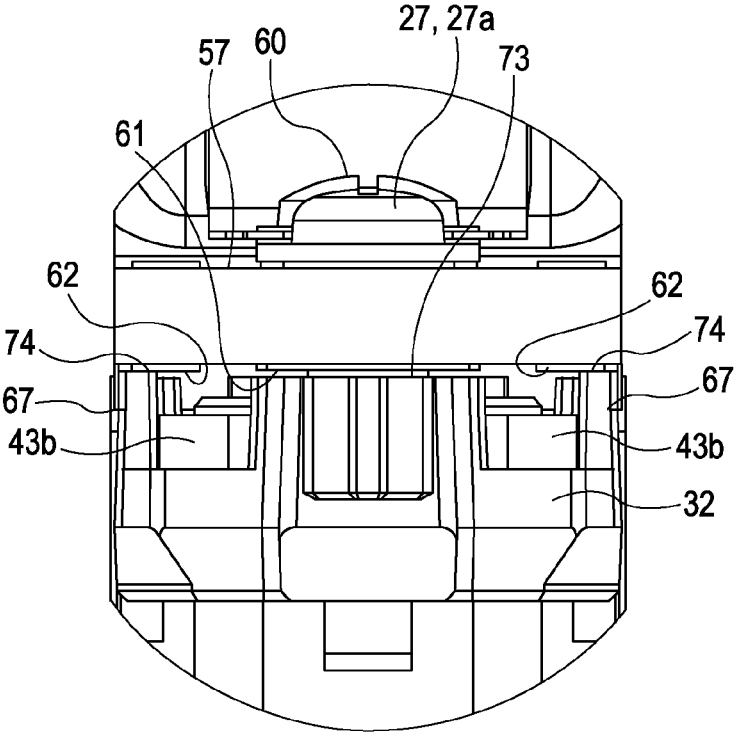
FIG. 19 is an enlarged view of region XIX in FIG. 16.
Figure 20:
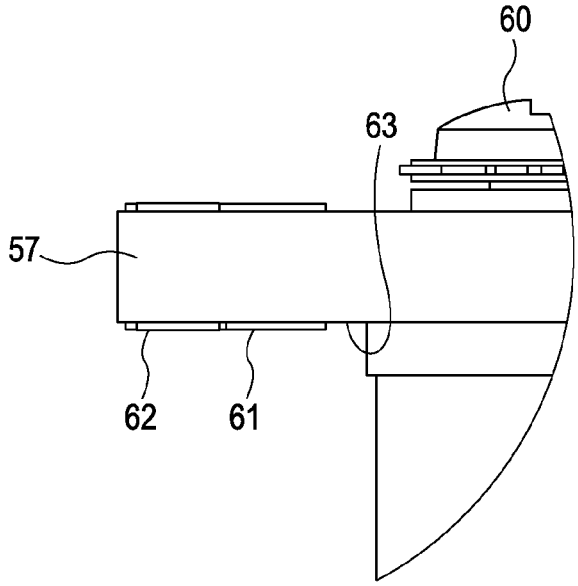
FIG. 20 is an enlarged view of region XX in FIG. 17A.
Figure 21:
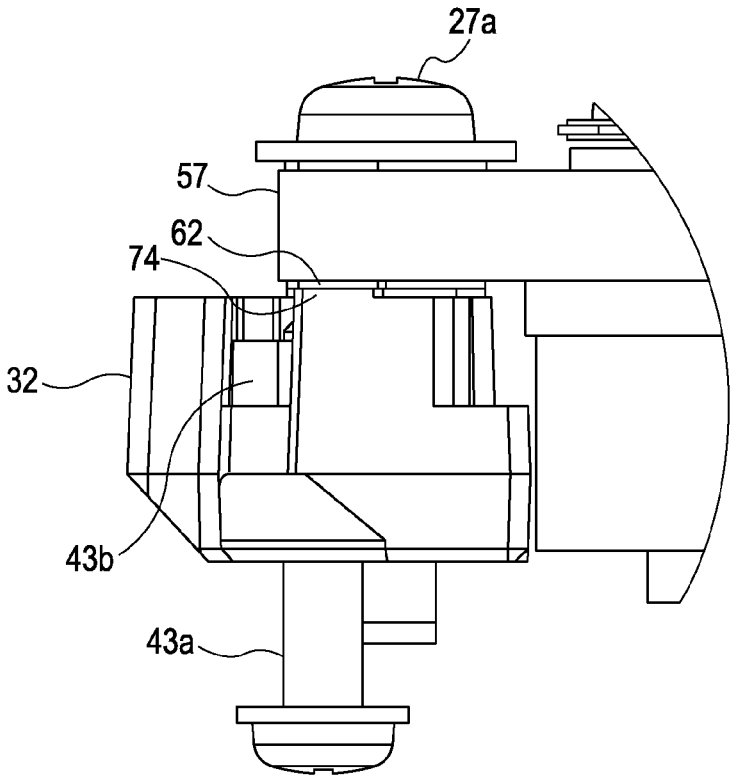
FIG. 21 is an enlarged view of region XXI in FIG. 17B.

FIG. 13 is a perspective view showing the configuration of the recording head 18 (a type of liquid ejecting head). FIGS. 14A and 14B are top views of the recording head 18, without and with the spacers 32, respectively. FIGS. 15A and 15B are bottom views of the recording head 18, without and with the spacers 32, respectively. FIGS. 16A and 16B are front views of the recording head 18, without and with the spacers 32, respectively. FIGS. 17A and 17B are right side views of the recording head 18, without and with the spacers 32, respectively. Furthermore, FIGS. 18A and 18B are enlarged views of region XVIIIA and region XVIIIB in FIG. 14, respectively. FIG. 19 is an enlarged view of region XIX in FIG. 16, FIG. 20 is an enlarged view of region XX in FIG. 17A, and FIG. 21 is an enlarged view of region XXI in FIG. 17B. Basically, the recording heads 18 have the same structure. Therefore, only one of the five recording heads 18 attached to the sub-carriage 26 is shown.

The recording head 18 has, in a head case 52, a flow path unit that forms an ink flow path including pressure chambers communicating with nozzles 51, and pressure generators (not shown), such as piezoelectric vibrators or heat-generating elements, which cause the pressure fluctuation of ink in the pressure chambers. In plan view, the recording head 18 according to this embodiment is long in the direction along the nozzle rows and is short in the width direction, i.e., a direction perpendicular to the nozzle rows. When a driving signal is applied from the control unit of the printer 1 to the pressure generators to drive the pressure generators, the recording head 18 performs a recording operation, i.e., the recording head 18 ejects ink from the nozzles 51 onto a recording medium, such as a recording sheet. Several rows of nozzles 51 for ejecting ink, forming nozzle rows 56 (a nozzle group), are provided in the nozzle forming surface 53 of the recording head 18. Two nozzle rows 56 are provided in a direction perpendicular to the nozzle rows. Each nozzle row 56 includes, for example, 360 nozzles provided at a pitch of 360 dpi.

The head case 52 is a hollow box-like member, and the flow path unit is fixed to the tip thereof so as to expose the nozzle forming surface 53. Furthermore, the pressure generators etc., are accommodated in an accommodating space provided in the head case 52, and the sub-tank 37 that supplies ink to the flow path unit is fitted to the base end surface (top surface) opposite to the tip end surface. Furthermore, flange portions 57 (intermediate-member fixing portions in the invention) protruding to the side in the direction along the nozzle rows are provided at both ends of the top surface of the head case 52. As shown in FIGS. 18A and 18B, these flange portions 57 have spacer attaching holes 54 corresponding to the head insertion holes 68 in the spacers 32. When the spacers 32 are attached to the flange portions 57 at both ends, the shafts of the spacer-fixing bolts 27*a* are inserted through the spacer attaching holes 54.

The spacer attaching holes 54 penetrate the flange portions 57 in the thickness direction, at the central portions of the flange portions 57 in the flange width direction, i.e., a direction perpendicular to the direction in which the flange portions 57 at both ends are arranged (a direction perpendicular to the direction in which the fastening portions with respect to the spacers 32 are arranged or the direction along the nozzle rows). As shown in FIG. 18A, in plan view, one of the spacer attaching holes 54 provided in the flange portions 57 at both ends (one on the left side in FIG. 14A) is a round through-hole, whose inside diameter is slightly larger than the outside diameter of the shaft of the spacer-fixing bolt 27*a*. Thus, the shaft of the spacer-fixing bolt 27*a* is smoothly inserted through the spacer attaching hole 54, while rattling therebetween is prevented. On the other hand, as shown in FIG. 18B, in plan view, the other of the spacer attaching holes 54 (one on the right side in FIG. 14A) is an elongated hole elongated in the direction in which the spacer attaching holes 54 are arranged (the direction along the nozzle rows). The inside diameter of this spacer attaching hole 54 in the direction in which the attaching holes are arranged (the longer diameter) is sufficiently larger than the outside diameter of the shaft of the spacer-fixing bolt 27*a*, and the inside diameter of this spacer attaching hole 54 in the flange width direction perpendicular to the direction in which the attaching holes are arranged (the shorter diameter) is equal to the inside diameter of the aforementioned one of the spacer attaching holes 54. By making one of the spacer attaching holes 54 in the flange portions 57 a round hole and the other an elongated hole like this, when the spacers 32 fixed to the flange portions 57 are screwed to the spacer bonding surfaces 41 of the head attaching portions 40 of the sub-carriage 26, the difference in distance between the fastening holes 29 in the sub-carriage 26 and between the spacer attaching holes 54 is compensated for within the range of the longer diameter of the elongated hole.

Peripheral portions 61 of the spacer attaching holes 54 protrude further toward the spacers 32 in an attached state than the spacer fixing surfaces 63 (intermediate-member fixing surfaces) of the flange portions 57. The peripheral portions 61 are mound-like projections surrounding the openings of the spacer attaching holes 54. Furthermore, abutting protrusions 62, which are circular in plan view, are formed on the spacer fixing surfaces 63 of the flange portions 57, on the outer side of the spacer attaching holes 54 in the flange width direction. In this embodiment, the abutting protrusions 62 are provided on the outer corners of the flange portions 57. These abutting protrusions 62 protrude further toward the attached spacers 32 than the spacer fixing surfaces 63 of the flange portions 57.

In addition, a round hole 76*a* serving as the reference when positioned with respect to the spacer 32 is provided in one of the flange portions 57 at both ends, namely, a flange portion 57*a* (one on the left side in FIG. 14A), at a position corresponding to a positioning hole 77*a* (described below) in the spacer 32. Similarly, an elongated hole 76*b* serving as the reference when positioned with respect to the spacer 32 is provided in the other of the flange portions 57, namely, a flange portion 57*b* (one on the right side in FIG. 14A), at a position corresponding to a positioning hole 77*b* in the spacer 32.

As shown in FIG. 18A, the round hole 76*a* penetrates the flange portion 57*a* in the thickness direction, at a position in the flange portion 57*a* not interfering with the spacer attaching hole 54, the peripheral portion 61, or the abutting protrusion 62 and shifted from the center line (denoted by the reference numeral "O" in FIG. 18A) to one side in the flange width direction (to the lower side in FIG. 18A) by a distance "x". In plan view, the round hole 76*a* is a through-hole that has a round opening, and the inside diameter thereof is slightly larger than the outside diameter of a positioning pin (not shown) of a positioning jig. Furthermore, as shown in FIG. 18B, the elongated hole 76*b* penetrates the flange portion 57*a* in the thickness direction, at a position not interfering with the spacer attaching hole 54, the peripheral portion 61, or the abutting protrusion 62 and shifted from the center line (denoted by the reference numeral "O" in FIG. 18B) to one side in the flange width direction (to the lower side in FIG. 18B) by the distance x (which is the same as the distance between the center line O and the round hole 76*a*). In plan view, the elongated hole 76*b* is a through-hole that has an elongated circular opening in the direction in which the positioning holes are arranged. The inside diameter of the elongated hole 76*b* in the direction in which the positioning holes are arranged (longer diameter) is sufficiently larger than the outside diameter of the positioning pin of a positioning jig 79, and the inside diameter in the flange width direction (shorter diameter) is equal to the inside diameter of the round hole 76*a*. By making one of the flange portions 57, namely, the flange portion 57*a* the round hole 76*a* and the other of the flange portions 57, namely, the flange portion 57*b*, the elongated hole 76*b* in this manner, when the spacers 32 to be fixed to the flange portions 57 are positioned, the difference in distance between the round hole 76*a* and the elongated hole 76*b* and between the positioning pins is compensated for within the range of the gap between the positioning pin and the elongated hole 76*b*.

A cover member 58 that protects the flow path unit and the peripheral portion of the nozzle forming surface 53 from a recording sheet or the like is attached to the tip end surface of the head case 52. The cover member 58 is made of a thin conductive metal plate, such as a stainless steel plate. The cover member 58 according to this embodiment is basically composed of a frame-shaped frame portion 58*a* that has an opening window 59 at the central portion thereof, and side plate portions 58*b* that extend from the edges of the frame portion 58*a* in the direction of the nozzle rows along the side surfaces of the head case 52, in a state in which the cover member 58 is attached to the head case 52. The tips of the side plate portions 58*b* are bent outward along the flange portions 57 and screwed to the flange portions 57 with cover fastening screws 60. The cover member 58 not only protects the flow path unit and the peripheral portion of the nozzle forming surface 53, but also adjusts the potential of the nozzle forming surface 53 to the ground potential.

The sub-tank 37 introduces ink from the flow path member 24 into the pressure chambers of the recording head 18. The sub-tank 37 has a self-sealing function to control the flow of ink into the pressure chambers by opening or closing a valve in response to pressure fluctuations occurring therein. The flow-path connecting portions 38, to which the connecting flow paths of the flow path member 24 are connected, are provided at both ends, in the direction along the nozzle rows, of the rear end surface (top surface) of the sub-tank 37. Ring-like gaskets (not shown) are fitted to the flow-path connecting portions 38, thereby ensuring the liquid-tightness with respect to the flow path member 24. Furthermore, a driving substrate (not shown) for supplying driving signals to the pressure generators is provided in the sub-tank 37. A connector 49 via which a flexible cable (a type of wiring member; not shown) is electrically connected to the driving substrate is provided in an opening provided at the central portion of the rear end surface of the sub-tank 37.

Figure 22:
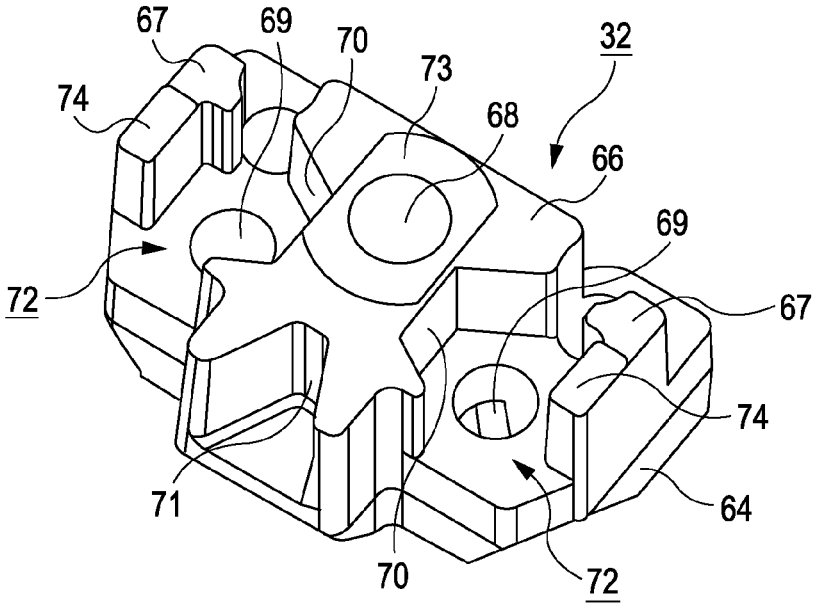
FIG. 22 is a perspective view showing the configuration of a spacer.
Figure 23:
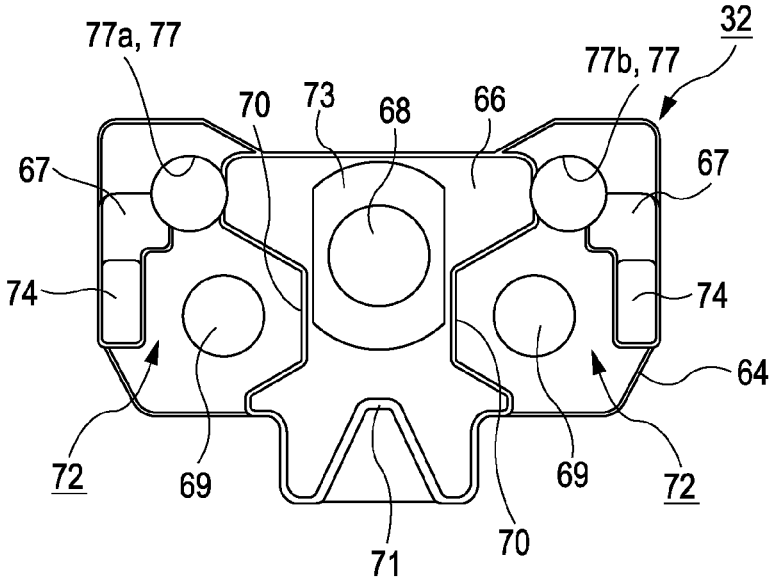
FIG. 23 is a top view showing the configuration of the spacer.
Figure 24A:
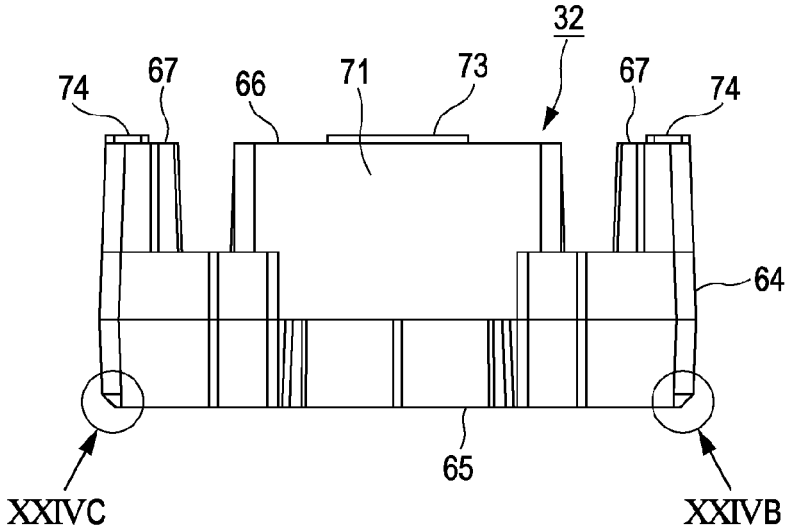
FIGS. 24A to 24C are a front view showing the configuration of the spacer, an enlarged view of region XXIVB in FIG. 24A, and an enlarged view of region XXIVC in FIG. 24A, respectively.
Figure 24B:
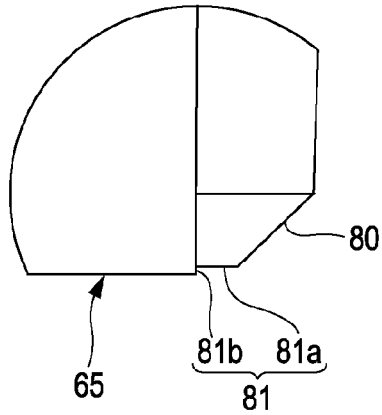
Figure 24C:
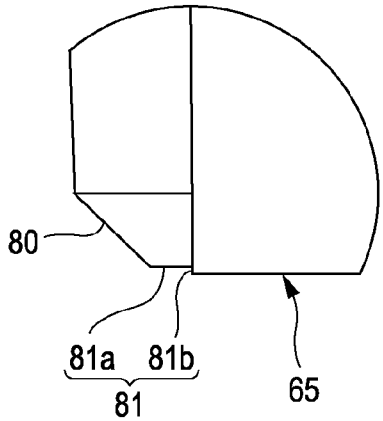
Figure 25A:
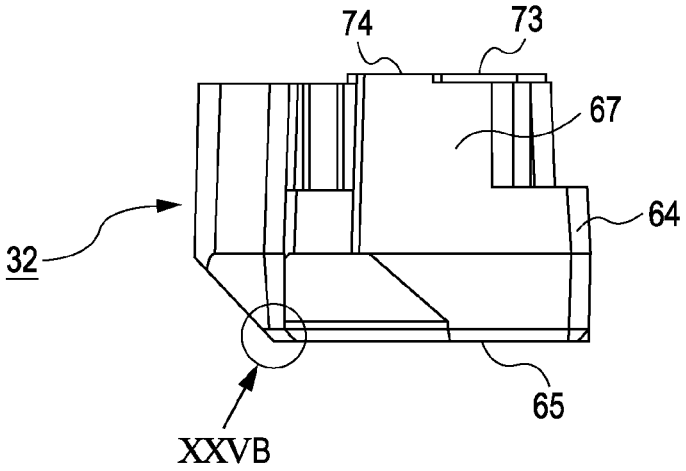
FIGS. 25A and 25B are a right side view showing the configuration of the spacer, and an enlarged view of region XXVB in FIG. 25A, respectively.
Figure 25B:
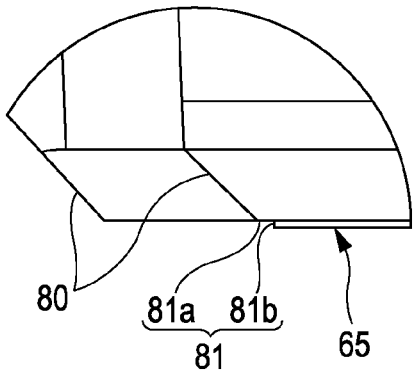
Figure 26:
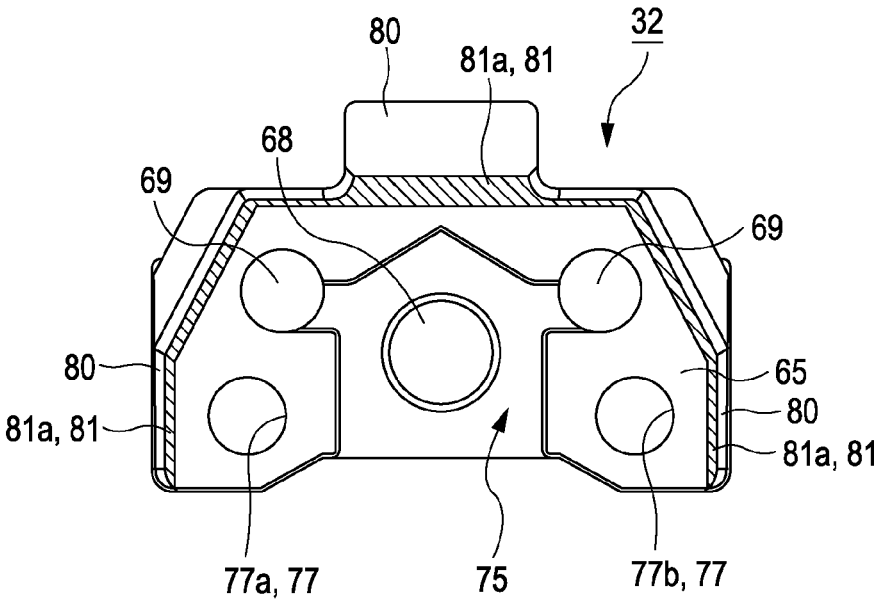
FIG. 26 is a bottom view showing the configuration of the spacer.
Figure 27:
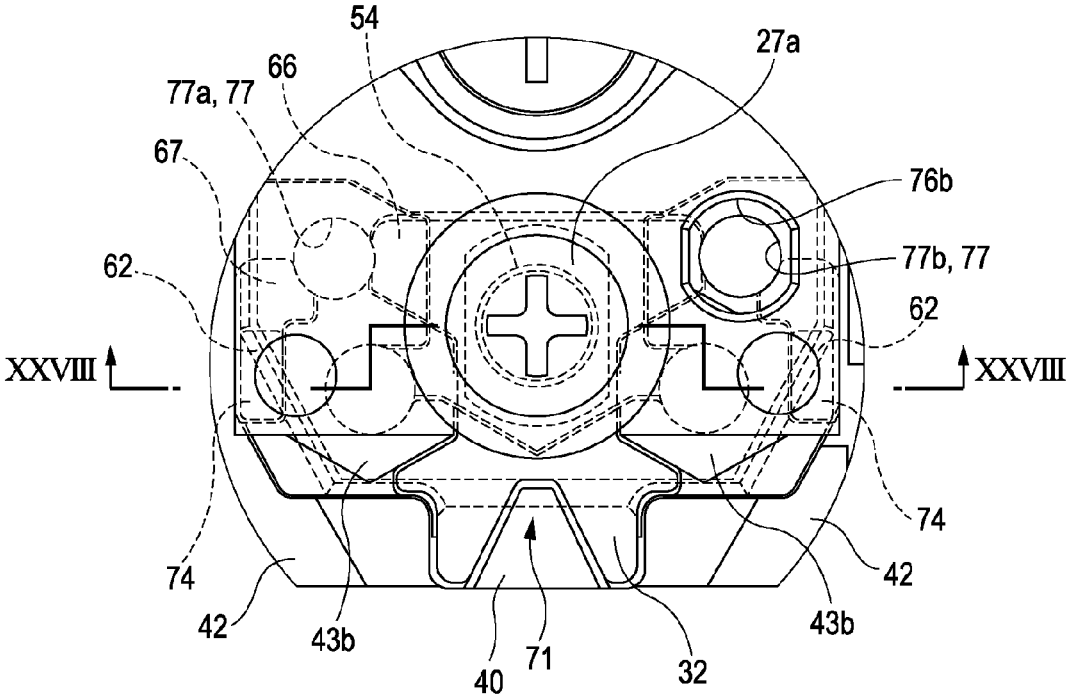
FIG. 27 is an enlarged view of a spacer fixing portion of a flange portion.

FIG. 22 is a perspective view of the spacer 32 (a type of intermediate member). FIG. 23 is a top view of the spacer 32. FIG. 24A is a front view of the spacer 32, FIG. 24B is an enlarged view of region XXIVB in FIG. 24A, and FIG. 24C is an enlarged view of region XXIVC in FIG. 24A. FIG. 25A is a right side view of the spacer 32, and FIG. 25B is an enlarged view of region XXVB in FIG. 25A. FIG. 26 is a bottom view of the spacer 32. Furthermore, FIG. 27 is an enlarged plan view of a mounting position of the spacer 32 in the flange portion 57 (an enlarged view of region XXVII in FIG. 10), and FIG. 28 is a cross-sectional view taken along line XXVIII-XXVIII in FIG. 27.

The spacers 32 according to this embodiment are made of synthetic resin. Two spacers 32 are attached to one recording head 18, more specifically, the spacers 32 are attached to the spacer attaching surfaces 63 (the surfaces on the sub-tank 37 side) of the flange portions 57 at both ends. Each spacer 32 is basically composed of a spacer body 64 that has the base surface 65 (a type of head-fixing-member bonding surface of the invention) to be disposed on the spacer bonding surface 41 of the head attaching portion 40 of the sub-carriage 26, a central projecting portion 66 that is formed at the central portion of the spacer body 64 in the width direction (the flange width direction when attached to the flange portion 57), and side walls 67 that are formed on both sides of the central projecting portion 66 in the width direction at a certain distance therefrom. In plan view, the width of the spacer 32 is substantially the same as the width of the flange portion 57. Furthermore, when the spacer 32 is appropriately attached to the flange portion 57, a portion of the central projecting portion 66 (described below) protrudes to the side slightly further than the protruding end of the flange portion 57.

The central projecting portion 66 protrudes from the spacer body 64 toward the flange portion 57 in an attached state. Notches that conform to the shape of three sides of head-fixing nuts 43*b* (see FIG. 27 etc.) in plan view are provided in the side surfaces of the central projecting portion 66 in the width direction. These notches serve as head-fixing-nut notches 70 that restrict the orientation of the head-fixing nuts 43*b* in the horizontal direction (that is, the rotation during fastening) in cooperation with the inner walls of the side walls 67. In other words, the spacer body 64, the nut notches 70, and the side walls 67 define head-fixing-nut accommodating portions 72 in which the head-fixing nuts 43*b* are accommodated. Before the spacers 32 are fixed to the flange portions 57, the head-fixing nuts 43*b* are fitted to the head-fixing-nut accommodating portions 72.

One end of the central projecting portion 66 in the depth direction (the end opposite to the sub-tank 37 when attached to the flange portion 57) protrudes to the side from the spacer body 64. A jig notch 71 that is substantially triangular in plan view and is gradually reduced in width from one end toward the other end in the depth direction is provided in the protruded portion. A head-retaining jig is fitted to the jig notch 71 when the recording head 18 is positioned with respect to the spacer bonding surface 41 of the head attaching portion 40 of the sub-carriage 26.

The head insertion hole 68 is provided at the central portion of the central projecting portion 66 in the width direction, at a position corresponding to the spacer attaching hole 54 in the flange portion 57 of the recording head 18. As shown in FIG. 23, the head insertion hole 68 is a round through-hole in plan view. The inside diameter of the head insertion hole 68 is slightly larger than the outside diameter of the shaft of the spacer-fixing bolt 27*a* and is equal to the inside diameter of the spacer attaching hole 54. A peripheral portion 73 of the head insertion hole 68 protrudes toward the flange portion 57 in an attached state further than the protruding end of the central projecting portion 66. In plan view, the peripheral portion 73 is a mound-like projection surrounding the opening of the head insertion hole 68 and is provided at a position corresponding to the peripheral portion 61 of the flange portion 57.

The sub-carriage insertion holes 69 (a type of insertion hole of the invention) are provided in the head-fixing-nut accommodating portions 72 defined on both sides of the central projecting portion 66 at positions corresponding to the fastening holes 29 provided in the head attaching portions 40 of the sub-carriage 26. As shown in FIG. 23, in plan view, these sub-carriage insertion holes 69 are round through-holes, and the inside diameter thereof is slightly larger than the outside diameter of the shafts of head-fixing bolts 43*a* (a type of fastening member of the invention). Thus, the shafts of the head-fixing bolts 43*a* are smoothly inserted through the sub-carriage insertion holes 69, while rattling therebetween is prevented. Thus, each spacer 32 has one head insertion hole 68 and two sub-carriage insertion holes 69. That is, the fastening portions between the spacer 32 and the sub-carriage 26 with the head-fixing bolts 43*a* and the head-fixing nuts 43*b* are located on the outer side of the fastening portion between the spacer 32 and the flange portion 57 in the width direction.

The side walls 67 provided at both ends of the spacer 32 in the width direction protrude from the spacer body 64 toward the flange portion 57 in an attached state and are continuous with the side surfaces of the spacer body 64 in the width direction. The protruding ends of the side walls 67 are flush with the protruding end of the central projecting portion 66. Furthermore, abutting projections 74 that protrude toward the flange portion 57 in an attached state are provided on the protruding ends of the side walls 67. These abutting projections 74 are provided such that they come into contact with the abutting protrusions 62 when the spacer 32 is appropriately attached to the flange portion 57 (when they are fastened with the spacer-fixing bolt 27*a* and a spacer-fixing nut 27*b*).

The spacer 32 has a spacer-fixing-nut accommodating portion 75 at the central portion of the base surface 65 in the width direction. In plan view, the spacer-fixing-nut accommodating portion 75 is a recess that conforms to the shape of a portion of the spacer-fixing nut 27*b* and is recessed from the base surface 65 to a certain point of the spacer 32 in the thickness direction. When the spacer-fixing nut 27*b* is fitted to the spacer-fixing-nut accommodating portion 75 and is placed on the bottom of the recess, the orientation of the spacer-fixing nut 27*b* in the horizontal direction is restricted by the inner walls of the spacer-fixing-nut accommodating portion 75. That is, the rotation of the spacer-fixing nut 27*b* is prevented when fastened with the spacer-fixing bolt 27*a*. Furthermore, the head insertion hole 68 is provided in the bottom of the recess of the spacer-fixing-nut accommodating portion 75. In addition, two positioning holes 77 (77*a* and 77*b*) penetrate the spacer 32 in the thickness direction, at positions between the central projecting portion 66 and the side walls 67 and shifted from the head-fixing-nut accommodating portions 72. These positioning holes 77*a* and 77*b* are symmetrical with respect to the central portion of the spacer 32 in the width direction.

The positioning holes 77 according to this embodiment are circular through-holes in plan view. The positioning hole 77*a* (one on the left side in FIG. 23) is provided in the spacer 32, at a position corresponding to the round hole 76*a* in a state in which the spacer 32 is attached to the flange portion 57*a*. On the other hand, the positioning hole 77*b* (one on the right side in FIG. 23) is provided in the spacer 32, at a position corresponding to the elongated hole 76*b* in a state in which the spacer 32 is attached to the flange portion 57*b*. That is, each spacer 32 has the positioning hole 77*a* corresponding to the round hole 76*a* in the flange portion 57*a* and the positioning hole 77*b* corresponding to the elongated hole 76*b* in the flange portion 75*b*.

Furthermore, a portion of the outer edge of the base surface 65 of the spacer 32, i.e., both sides in the width direction of the spacer 32 and one side in the depth direction of the base surface 65 (the side opposite to the sub-tank 37 when attached to the flange portion 57) are chamfered. That is, a portion of the outer edge of the base surface 65 is provided with a chamfered portion 80 that is gradually spaced apart from the spacer bonding surface 41 (inclined) from the inner side toward the outer side of the base surface 65, in a state in which the spacer 32 is attached to the spacer bonding surface 41 of the head attaching portion 40. In this embodiment, the chamfered portion 80 is provided so as to extend from one corner (the lower left corner in FIG. 26) of both corners on the other side of the base surface 65 in the depth direction (the sub-tank 37 side when attached to the flange portion 57) to the other corner (lower right in FIG. 26) via the base portion of the protruded portion provided with the jig notch 71 (the boundary with respect to the base surfaces 65). The chamfered portion 80 is an inclined surface that is inclined upward at 45 degrees from the base surface 65 toward the opposite side and serves as a buffer in which adhesive collected in the chamfered portion 80 is stored. Although the chamfered portion 80 of the invention is formed as a so-called C surface that is inclined with respect to the base surface 65 (bottom surface), it may be formed as a so-called R surface that has roundness (curvature).

In addition, a step portion 81 recessed toward a side opposite to the base surface 65 is provided on the base surface 65 of the spacer 32, along the boundary between the base surface 65 and the chamfered portion 80. The step portion 81 includes a step surface 81*a* parallel to the base surface 65 on a side opposite to the base surfaces 65, and a connecting surface 81*b* connecting the inner edge of the step surface 81*a* and the outer edge of the base surface 65. In this embodiment, the step portion 81 is provided between the base surface 65 and the chamfered portion 80 on both sides in the width direction of the spacer 32, and between the base surface 65 and the base portion of the protruding portion provided with the jig notch 71. The drop between the step surface 81*a* of the step portion 81 and the base surface 65 (the amount of the recess) is sufficiently smaller than the thickness of the spacer 32. When the base surface 65 of the spacer 32 is in contact with the spacer bonding surface 41 of the head attaching portion 40 of the sub-carriage 26, a slight gap is created between the step portion 81 and the spacer bonding surface 41. Therefore, when adhesive is injected from the chamfered portion 80 in a bonding step described below, the adhesive is guided to the step portion 81 by capillary force and is collected therein. The adhesive collected in the step portion 81 is distributed along the outer edge of the base surface 65 due to capillary force. The step portion 81 serves as a buffer in which the adhesive is stored.

Next, the production process (assembly process) of the head unit 17 will be described. The spacers 32 configured as above are fastened to the recording flange portions 57*a* and 57*b* on both sides of the head 18 with the spacer-fixing bolts 27*a* and the spacer-fixing nuts 27*b* before the recording head 18 is attached to the sub-carriage 26 (a spacer attaching step). In this spacer attaching step (a type of intermediate-member fixing step of the invention), first, the recording head 18 is placed on the positioning jig (not shown). The positioning jig 79 has a pair of positioning pins (not shown) standing upright, one inserted through the round hole 76*a* in the flange portion 75*a* and another inserted through the elongated hole 76*b* in the flange portion 75*b*, thereby restricting the position of the recording head 18 in the horizontal direction (the surface direction parallel to the nozzle forming surface) with respect to the positioning jig. Herein, the inside diameter of the elongated hole 76*b* in the direction in which the positioning holes are arranged is larger than the outside diameter of the positioning pins. Thus, the difference in distance between the round hole 76*a* and the elongated hole 76*b* and between the positioning pins is compensated for within the range of the gap between the other positioning pin and the elongated hole 76*b*.

When the recording head 18 is placed on the positioning jig, the spacers 32 are disposed on the flange portions 57*a* and 57*b* of the recording head 18. The spacers 32 are disposed symmetrically with respect to the head body (i.e., disposed at positions rotated by 180 degrees from each other) on the flange portions 57 such that the insertion-hole peripheral portions 73 face the peripheral portions 61 of the flange portions 57 and such that the jig notches 71 face opposite to each other (outward). At this time, the spacer 32 to be disposed on the flange portion 57*a* is positioned with respect to the flange portion 57*a* by inserting one positioning pin protruding from the round hole 76*a* into the positioning hole 77*a* in the flange portion 75*a*. Note that another jig (not shown) is used to prevent the rotation of the spacer 32 about the positioning hole 77*a*. Similarly, the spacer 32 to be disposed on the flange portion 57*b* is positioned with respect to the flange portion 57*b* by inserting the other positioning pin protruding from the elongated hole 76*b* in the flange portion 75*b* into the positioning hole 77*b*. The spacers 32 positioned in this manner are fastened to the flange portions 57 with the spacer-fixing bolts 27*a* and the spacer-fixing nuts 27*b*. Thus, the spacers 32 are symmetrically positioned and fixed to the flange portions 57*a* and 57*b*.

Before the spacer 32 disposed on the flange portion 57 is fastened with the spacer-fixing bolt 27*a* and the spacer-fixing nut 27*b*, the abutting protrusions 62 and the abutting projections 74 are in contact with each other at both ends located farthest from the fastening portion in the flange width direction, and a gap G (see FIG. 28) is created at the fastening portion (the portion to be fastened) of the spacer 32 and the flange portion 57, that is, between the peripheral portion 61 of the spacer attaching hole 54 and the peripheral portion 73 of the head insertion hole 68. Thus, after the spacer 32 is fastened to the flange portion 57 with the spacer-fixing bolt 27*a* and the spacer-fixing nut 27*b*, the abutting protrusions 62 and the abutting projections 74 are in contact with each other more preferentially than other portions, on the outer side of the fastening portion between the spacer 32 and the flange portion 57 and the fastening portions between the spacer 32 and the sub-carriage 26 in the flange width direction. Because the abutting protrusions 62 are in contact with the abutting projections 74, the position and orientation of the spacer 32 with respect to the flange portion 57 are restricted in the height direction. This configuration prevents the recording head 18 and the spacer 32 from being inclined relative to each other in a direction perpendicular to a virtual line connecting the fastening portions of the flange portions 57 at both ends, i.e., in a direction along the short sides of the recording head 18 in this embodiment. Accordingly, also when the recording head 18 is attached to the sub-carriage 26 via the spacers 32, the recording head 18 can be prevented from being inclined with respect to the sub-carriage 26 in a direction along the short sides of the recording head 18.

Once the spacers 32 are fixed to the flange portions 57 at both ends of the recording head 18, the recording head 18 is positioned with respect to the head attaching portion 40 of the sub-carriage 26. In this positioning step, for example, the recording head 18 is placed in such a manner that the base surfaces 65 of the spacers 32 fixed to flange portions 57 of the recording head 18 face the spacer bonding surfaces 41 of the pair of head attaching portions 40 of the base portion 26*a* of the sub-carriage 26 corresponding to the base surfaces 65 of the spacers 32. Then, while observing the nozzle forming surface 53 of the recording head 18 using an image-capturing unit, such as a CCD camera, the position of the recording head 18 on the head attaching portion 40 of the base portion 26*a* is adjusted so that a plurality of (at least two) preliminarily selected nozzles 51 in the nozzle forming surface 53 are located at predetermined positions.

Once the recording head 18 to be attached is positioned, the spacers 32 attached to this recording head 18 are temporary fixed to the spacer bonding surfaces 41 of the head attaching portions 40 of the base portion 26*a* with adhesive (a bonding step). In this bonding step, the adhesive is injected between the spacers 32 and the spacer bonding surfaces 41 of the head attaching portions 40 using a dispenser, such as a microsyringe. Thus, the adhesive injected therebetween is guided to the gaps between the base surfaces 65 and the spacer bonding surfaces 41 by capillary force and distributed over the gaps. At this time, the adhesive collected in the chamfered portions 80 flow along the chamfered portions 80 into the outer edges of the base surfaces 65 and is collected in the chamfered portions 80. Furthermore, the adhesive flowing inward of the base surfaces 65 is collected in the step portions 81 and flows along the step portions 81 by capillary force. Thus, the adhesive flows along the step portions 81 into the outer edges of the base surfaces 65 and is collected in the step portions 81. Thus, the adhesive can be made to easily flow along the outer edges of the spacers 32 and prevented from flowing out of the outer edges of the spacers 32. This improves the bonding between the sub-carriage 26 and the spacers 32, increasing the accuracy of mounting position of the recording head 18. In addition, the adhesive flowing out of the spacer bonding surfaces 41 of the head attaching portions 40 is collected in the adhesive receiving portions 42. Thus, the overflowed adhesive is prevented from flowing into the spacer bonding surfaces 41 of the adjacent recording head 18.

In this manner, the base surfaces 65 of the spacers 32 are temporary fixed to the spacer bonding surfaces 41 of the head attaching portions 40 of the base portion 26*a* with adhesive. Although preferred adhesives used in this temporary fixing include a so-called instant adhesive mainly composed of cyanoacrylate, any other adhesive that is rigid enough to fix the recording head 18 to the sub-carriage 26 without rattling when completely cured may be used. For example, an ultraviolet (UV) curing adhesive may be employed. In such a case, it is preferable that the spacers 32 or the sub-carriage 26 be made of a transparent material. After the adhesive is cured, the spacers 32 and the base portion 26*a* are fastened with the head-fixing bolts 43*a* and the head-fixing nuts 43*b*, and the recording head 18 is securely fixed to a predetermined position of the base portion 26*a*.

The recording heads 18 are attached to the sub-carriage 26 by following these steps. Then, the flow path member 24 is fixed to the sub-carriage 26. As described above, the flow path member 24 is fixed to the sub-carriage 26 with the flow-path fastening screws 45. At this time, the connecting flow paths of the flow path member 24 are inserted into the corresponding flow-path connecting portions 38 of the sub-tanks 37 of the recording heads 18 and connected thereto in a liquid-tight manner. The flow path member 24 may be fixed to the sub-carriage 26 before the recording heads 18 are attached to the sub-carriage 26.

By going through the above-described steps, the head unit 17 is completed. As described above, the head unit 17 is accommodated in the carriage body 12 such that the nozzle forming surfaces 53 of the recording heads 18 are exposed from the bottom opening 19 in the bottom plate 12*a* of the carriage body 12. After the orientation, such as the position and the inclination, of the head unit 17 with respect to the carriage body 12 is adjusted, the head unit 17 is fixed to the carriage body 12 with the head-unit fixing screws 22.

As has been described above, in the head unit 17 according to this embodiment, the recording heads 18 each have the flange portions 57 to which the spacers 32 are fixed, and the spacers 32 each have the base surface 65 to be securely bonded to the spacer bonding surface 41 of the head attaching portion 40 of the sub-carriage 26 with adhesive. Furthermore, a portion of the outer edge of the base surface 65, i.e., both sides in the width direction of the spacer 32 and one side in the depth direction of the base surface 65, is provided with the chamfered portion 80 that is gradually spaced apart from the spacer bonding surface 41 from the inner side toward the outer side of the base surface 65, along the outer edge. Thus, the adhesive injected from the chamfered portion 80 can be guided to the gap between the base surface 65 and the spacer bonding surface 41 by capillary force and distributed over the gap between the base surface 65 and the spacer bonding surface 41. Furthermore, the chamfered portion 80 can be used as a buffer in which the adhesive is stored. Thus, the adhesive can be prevented from flowing out of the outer edge of the spacer 32 and made to easily flow along the outer edge of the spacer 32. This improves the bonding between the sub-carriage 26 and the spacers 32, increasing the accuracy of mounting position of the recording heads 18.

Furthermore, the step portion 81 that is recessed toward a side opposite to the spacer bonding surface 41 is provided along the boundary of the base surface 65 and the spacer bonding surface 41. Thus, the adhesive is guided to the step portion 81 by capillary force, making the adhesive flow more easily along the boundary of the base surface 65 and the spacer bonding surface 41, i.e., along the outer edge of the base surface 65. Furthermore, the step portion 81 can be used as a buffer in which the adhesive is stored.

Furthermore, the sub-carriage 26 includes the head attaching portions 40 provided with the spacer bonding surfaces 41, and the adhesive receiving portions 42 recessed toward a side opposite to the spacer bonding surfaces 41 on the outer side of the head attaching portions 40. Because the head attaching portions 40 have the shape of an island protruding toward the base surfaces 65, by strictly controlling the shape and dimension of the head attaching portions 40 (the spacer bonding surfaces 41), the positional accuracy of the spacers 32 to be securely bonded to the spacer bonding surfaces 41 is improved. Furthermore, the adhesive flowing out of the spacer bonding surfaces 41 of the head attaching portions 40 can be collected in the adhesive receiving portions 42. Thus, the adhesive flowing out of the spacer bonding surface 41 can be prevented from flowing in the spacer bonding surfaces 41 corresponding to the adjacent liquid ejecting heads 18 when a plurality of recording heads 18 are arranged in the sub-carriage 26.

Furthermore, because the printer 1 of this embodiment includes the head unit 17 configured as above, the positional accuracy of the nozzles 51 with respect to the recording heads 18 is improved. Thus, the landing position accuracy of ink on a recording medium can be improved.

The invention is not limited to the above-described embodiments, and it can be variously modified within the scope of the claims.

Figure 29:
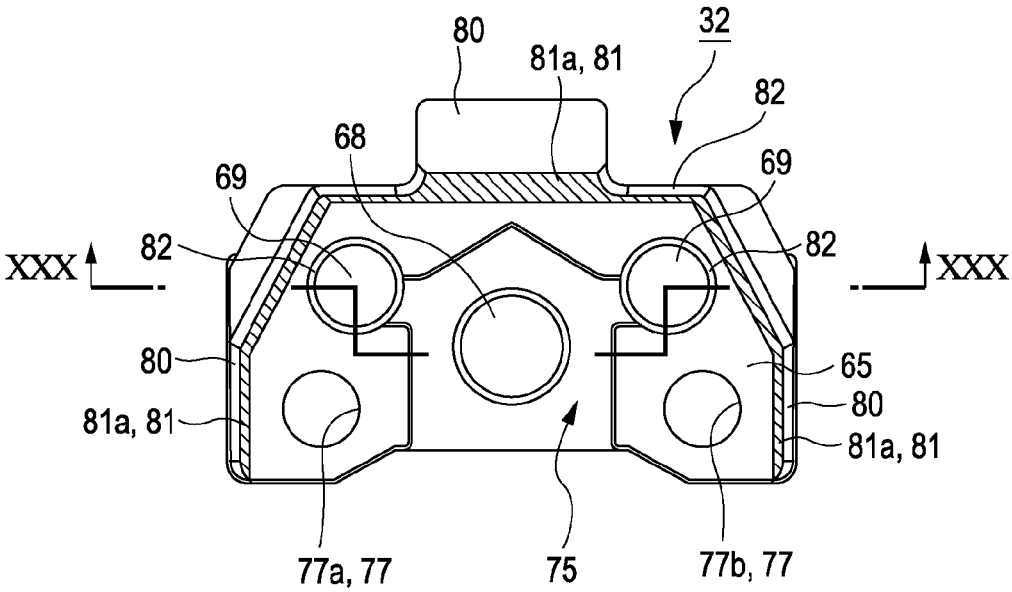
FIG. 29 is a bottom view showing the configuration of the spacer according to another embodiment.
Figure 30:
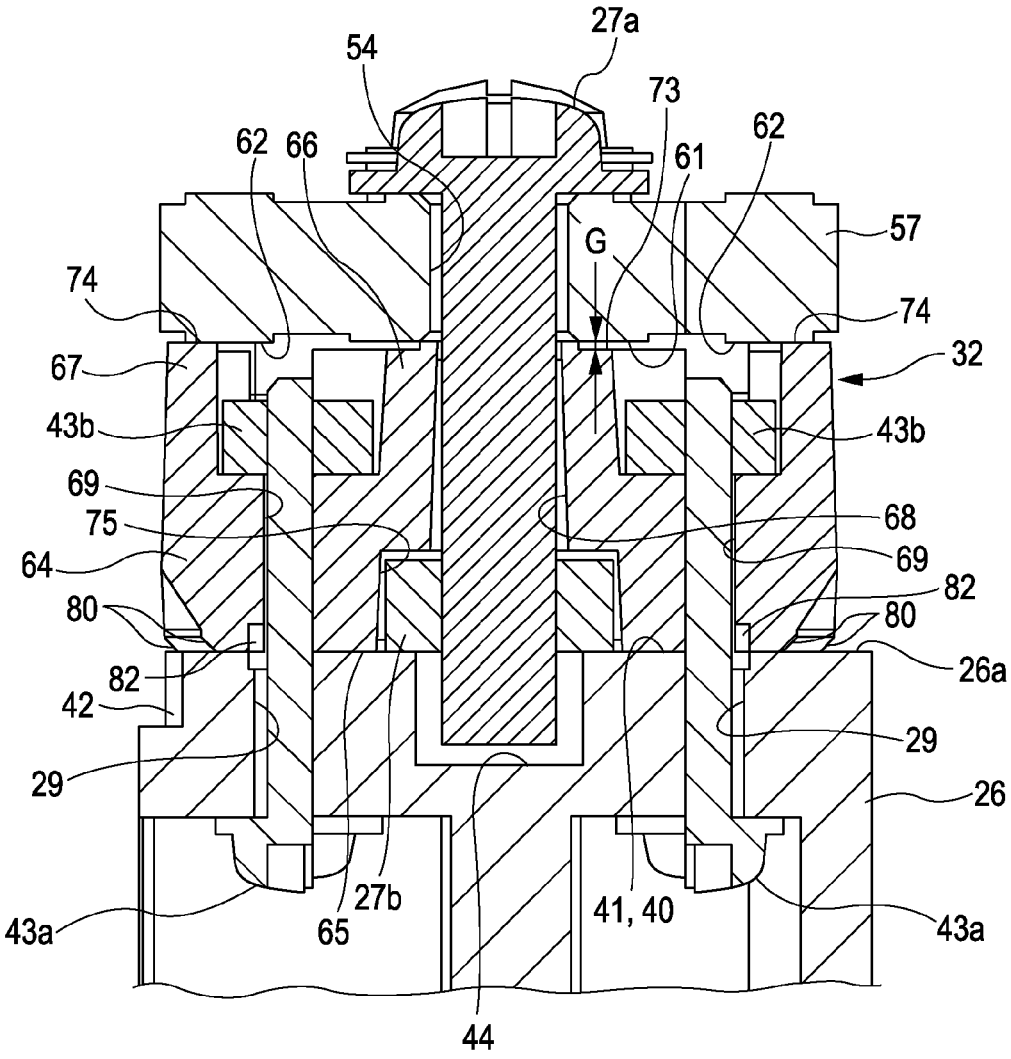
FIG. 30 is an enlarged cross-sectional view of the spacer fixing portion of the flange portion.

FIG. 29 is a bottom view showing the configuration of a spacer according to another embodiment, and FIG. 30 is an enlarged cross-sectional view of a spacer fixing portion of a flange portion (a cross-sectional view taken along line XXX-XXX in FIG. 29). For example, the sub-carriage insertion holes 69 in the base surface 65 of the spacer 32 may each be provided with a spot facing portion 82 around the opening. Each spot facing portion 82 is formed so as to be recessed from the base surface 65 to a certain point of the spacer 32 in the thickness direction, and the inside diameter thereof is set slightly larger than the inside diameter of the sub-carriage insertion hole 69. By employing this configuration, the adhesive flowing in the fastening holes 29 from the base surface 65 can be stored in the spot facing portion 82. Thus, the adhesive can be prevented from flowing upward in the fastening holes 29 from the base surface 65 side toward the recording head 18 side on the opposite side. As a result, the overflowed adhesive can be prevented from being deposited on the recording head 18.

Although the configuration in which ink is ejected from the recording heads 18 reciprocating relative to a recording medium has been described in the above-described embodiments, the invention is not limited thereto. It is possible to employ a configuration in which ink is ejected onto a recording medium that is moved relative to the fixed recording heads 18.

Although the above description has been given taking the ink jet printer 1, which is a type of liquid ejecting apparatus, as an example, the invention may be applied to another type of liquid ejecting apparatus that employs the configuration in which liquid ejecting heads are fixed to a head fixing member via intermediate members. For example, the invention may be applied to display manufacturing apparatuses used to manufacture color filters for liquid crystal displays, electrode manufacturing apparatuses used to manufacture electrodes for organic electro-luminescence (EL) displays and field-emission displays (FED), chip manufacturing apparatuses used to manufacture biochips, and micropipettes that precisely supply a tiny amount of sample solution.

What is claimed is:

1. A liquid ejecting head unit comprising:

a liquid ejecting head having a nozzle forming surface provided with nozzle rows consisting of several rows of nozzles for ejecting liquid; and a head fixing member to which the liquid ejecting head is fixed with an intermediate member therebetween, wherein the liquid ejecting head has an intermediate-member fixing portion to which the intermediate member is fixed, the intermediate member has a head-fixing-member bonding surface to be securely bonded to an intermediate-member bonding surface of the head fixing member with adhesive, and the head-fixing-member bonding surface has a chamfered portion along at least a portion of an outer edge thereof, the chamfered portion being provided such that the distance from the intermediate-member bonding surface gradually increases from the inner side toward the outer side of the head-fixing-member bonding surface.

2. The liquid ejecting head unit according to claim 1, wherein a step portion that is recessed toward a side opposite to the head-fixing-member bonding surface is provided along a boundary of the head-fixing-member bonding surface and the chamfered portion.

3. The liquid ejecting head unit according to claim 1, wherein the head fixing member has a head attaching portion provided with the intermediate-member bonding surface and has an adhesive receiving portion that is provided on the outer side of the head attaching portion and recessed toward a side opposite to the intermediate-member bonding surface, and the head attaching portion has the shape of an island protruding toward the head-fixing-member bonding surface.

4. The liquid ejecting head unit according to claim 1, wherein the intermediate member has an insertion hole through which a fastening member for fastening the intermediate member to the head fixing member is inserted, the insertion hole being provided with a spot facing portion around its opening in the bonding surface of the head-fixing member.

5. A liquid ejecting apparatus comprising the liquid ejecting head unit according to claim 1.

6. A liquid ejecting apparatus comprising the liquid ejecting head unit according to claim 2.

7. A liquid ejecting apparatus comprising the liquid ejecting head unit according to claim 3.

8. A liquid ejecting apparatus comprising the liquid ejecting head unit according to claim 4.

9. A method of producing a liquid ejecting apparatus that includes a liquid ejecting head having a nozzle forming surface provided with nozzle rows consisting of several rows of nozzles for ejecting liquid, and a head fixing member to which the liquid ejecting head is fixed with an intermediate member therebetween, the method comprising:

an intermediate-member fixing step in which the intermediate member is fixed to an intermediate-member fixing portion of the liquid ejecting head; and a bonding step in which a head-fixing-member bonding surface of the intermediate member is securely bonded to the intermediate-member bonding surface of the head fixing member with adhesive, wherein the head-fixing-member bonding surface has a chamfered portion along at least a portion of an outer edge thereof, the chamfered portion being provided such that the distance from the intermediate-member bonding surface gradually increases from the inner side toward the outer side of the head-fixing-member bonding surface.

* * * * *